United States Patent [19]

Takao et al.

[11] Patent Number: 5,063,829

[45] Date of Patent: Nov. 12, 1991

[54] VARIABLE DISPLACEMENT SWASH PLATE TYPE COMPRESSOR

[75] Inventors: Kunihiko Takao, Tsuchiura; Kenji Tojo, Ibaraki; Isao Hayase, Katsuta; Yukio Takahashi, Katsuta; Masaru Ito, Katsuta, all of Japan

[73] Assignee: Hitachi, Ltd., Tokyo, Japan

[21] Appl. No.: 563,716

[22] Filed: Aug. 7, 1990

[30] Foreign Application Priority Data

Aug. 9, 1989 [JP] Japan ..... 1-204668

[51] Int. Cl.[5] ..... F01B 3/00

[52] U.S. Cl. ..... 92/71; 92/12.2; 417/222 R; 74/60

[58] Field of Search ..... 92/12.2, 71; 417/269, 417/222, 222 S; 74/60

[56] References Cited

U.S. PATENT DOCUMENTS

| | | | |
|---|---|---|---|
| 2,706,384 | 4/1955 | Schott | 74/60 |
| 2,964,234 | 12/1960 | Loomis, III | 74/60 |
| 3,292,554 | 12/1966 | Hessler | 417/269 |
| 3,861,829 | 1/1975 | Roberts et al. | 417/269 |
| 4,030,404 | 6/1977 | Meijer | 92/12.2 |
| 4,077,269 | 3/1978 | Hodgkinson | 417/269 |
| 4,235,116 | 11/1980 | Meijer et al. | 417/222 |
| 4,475,871 | 10/1984 | Roberts | 417/270 |
| 4,801,248 | 1/1989 | Tojo et al. | 417/222 |
| 4,815,358 | 3/1989 | Smith | 417/269 |
| 4,836,090 | 6/1989 | Smith | 417/269 |

FOREIGN PATENT DOCUMENTS

| | | | |
|---|---|---|---|
| 3420529 | 12/1985 | Fed. Rep. of Germany | 417/269 |
| 142184 | 9/1981 | Japan . | |
| 286591 | 12/1986 | Japan . | |

OTHER PUBLICATIONS

Toyota Automatic Loom Works Technical Report '88 No. 18 pp. 60–61.

Nissan Motor Service Circular 5/89, R32, pp. 45–46.

*Primary Examiner*—Edward K. Look

*Assistant Examiner*—Thomas Denion

*Attorney, Agent, or Firm*—Antonelli, Terry Stout & Kraus

[57] ABSTRACT

A variable displacement swash plate type compressor operable with reduced vibration and noise and, hence, suitable for use in automotive air-conditioning refrigeration cycle has a main shaft adapted to be driven by a driving power source; a drive plate fixed to the main shaft; a swash plate main part tiltably engaging through an engaging portion with the drive plate so as to be tiltable with respect to the axis of the main shaft and to make a precessional rotation in accordance with the rotation of the main shaft; a piston support rotatably carried by the swash plate main part so as to make a precessional rotation together with the swash plate main part; pistons having one ends engaging with the piston support so as to reciprocatingly move in respective cylinders in accordance with the precessional rotation of the swash plate main part; and a mechanism for causing a change in the angle of tilt of the swash plate main part with respect to the axis of the main shaft so as to effect a control of displacement. The swash plate main part is provided with a balancing portion which cancels an unbalance of mass produced by the engaging portion at a predetermined angle of tilt of the swash plate so as to locate at least the gravity center of the swash plate main part on the axis of the main shaft.

21 Claims, 15 Drawing Sheets

VARIABLE DISPLACEMENT SWASH PLATE TYPE COMPRESSOR

BACKGROUND OF THE INVENTION

The present invention relates to a variable displacement swash plate type compressor for use as a refrigerant compressor of, for example, an automotive air conditioner and, more particularly, a variable displacement swash plate type compressor which reduces vibration and noise generated during operation of the compressor.

Variable displacement swash plate type compressors for automotive air conditioners are shown, for example, in Japanese Patent Publication No. 58-4195 and Japanese Unexamined Utility Model Publication No. 61-142184 and Unexamined Patent Publication No. 61-286591. Each of these known variable displacement swash plate type compressors includes a main shaft to which driving torque is transmitted from an automotive engine, a driving pin or a driving ring fixed to the shaft, a link mechanism or a cam mechanism engaging with the driving pin or the driving ring, a swash plate which changes its angle of tilt with respect to the main shaft by the operation of the link mechanism or the cam mechanism and is capable of making a precessional rotation, and pistons which engage the swash plate so as to be reciprocatingly driven by the precessional rotation of the swash plate.

During operation of this known compressor, an unbalance of centrifugal force is produced by the rotation of the compressor shaft and rotational parts as the sum of unbalance of centrifugal force acting on the driving pin or the driving ring and the unbalance of centrifugal force acting on the swash plate. Another unbalance of centrifugal force is also caused when the position of the center of gravity of a rocker plate, engaged with the swash plate to make a precessional rotation together with the swash plate, is spaced from the center of tilt of the swash plate. The extent or magnitude of the unbalance of centrifugal force acting on the driving pin or the driving ring is determined independently of the tilting angle of the swash plate. On the other hand, the magnitudes of the unbalance of centrifugal forces acting on the swash place and the rocker plate vary in dependence upon the distances of the centers of gravity of component parts of the swash plate and the rocker plate which in turn vary according to the angle of tilt of the swash plate. Consequently, the overall unbalance of the centrifugal force, synthesized from the unbalance components mentioned above, vary according to the angle of tilt of the swash plate even when the speed of rotation is unchanged. Thus, the magnitude of the overall unbalance of the centrifugal force varies according to the angle of tilt of the swash plate, so that a large unbalance is produced when the tilting angle is maximum, i.e., when the displacement is maximized, or when the tilting angle is minimum, i.e., when the displacement is minimized. This unbalance of centrifugal force causes a vibration of the compressor to generate large vibration and noise of the internal and external parts of the automobile. This problem is serious particularly when the engine is idling.

SUMMARY OF THE INVENTION

Accordingly, an object of the present invention is to provide a variable displacement swash plate type compressor with reduced levels of vibration and noise, thereby overcoming the above-described problems of the prior art.

To this end, according to the present invention, a variable displacement swash plate type compressor comprises: a main shaft adapted to be driven by a driving source, a drive plate fixed to the main shaft, and a swash plate main part tiltably engaging through an engaging portion with the drive plate so as to be tiltable with respect to the axis or the main shaft and to make a precessional rotation in accordance with the rotation of the main shaft. A piston support is rotatably carried by the swash plate main part so as to make a precessional rotation together with the swash plate main part, and pistons are provided each having a first end engaging with the piston support so as to reciprocatingly move in respective cylinders in accordance with the precessional rotation of the swash plate main part. Means are provided for causing a change in the angle of tilt of the swash plate main part with respect to the axis of the main shaft so as to effect a control of displacement, and the swash plate main part is provided with a balancing portion which cancels an unbalance of mass produced by the engaging portion at a predetermined angle of tilt of the swash plate so as to locate the gravity center of the swash plate main part substantially on the center of axis of the main shaft.

In accordance with further features of the invention, a variable displacement swash plate type compressor is provided including a main shaft adapted to be driven by a driving source, a drive plate fixed to the main shaft, and a swash plate main part tiltably engaging through an engaging portion with the drive so as to be tiltable with respect to the axis of the main shaft and to make a precessional rotation in accordance with the rotation of the main shaft. A piston support is rotatably carried by the swash plate main part so as to make a precessional rotation together with the swash plate main part and pistons are provided each having a first end engaging with the piston support so as to reciprocatingly move in respective cylinders in accordance with the precessional rotation of the swash plate main part; and means are provided for causing a change in the angle of tilt of the swash plate main part with respect to the axis of the main shaft so as to effect a control of displacement. An unbalance of mass of the swash plate main part produced by the engaging portion is canceled so that the center of gravity of the swash plate main part is located substantially on the axis of the main shaft, and the center of gravity of the piston support is positioned substantially on the center of tilt of the swash plate main part.

In accordance with still further features of the present invention, a variable displacement swash plate type compressor comprises a main shaft adapted to be driven by a driving source, a drive plate fixed to the main shaft, and a swash plate main part tiltably engaging through an engaging portion with the drive plate so as to be tiltable with respect to the axis of the main shaft and to make a precessional rotation in accordance with the rotation of the main shaft. A piston support is rotatably carried by the swash plate main part so as to make a processional rotation together with the swash plate main part, and pistons are provided each having a first end engaging with the piston support so as to reciprocatingly move in respective cylinders in accordance with the precessional rotation of the swash plate main part. Means are provided for causing a change in the angle of tilt of the swash plate main part with respect to the axis of the main shaft so as to effect a control of displacement; wherein an unbalance of mass of the swash plate main part produced by the engaging portion is canceled so that the center of gravity of the swash plate main part is located substantially on the axis of the main shaft, and the center of tilt of the swash plate main part is located at the same position as the center of gravity of the piston support.

In a preferred form of the invention, an additional mass is provided on a portion of the drive plate which is on the side of the axis of the main shaft opposite to the engaging portion, with the value of the additional mass being selected to adjust the angle of tilt of the swash plate main part at which unbalance of the centrifugal force acting on the main shaft is substantially canceled.

Alternatively, the main shaft is driven through a solenoid clutch having an armature, and wherein unbalance of centrifugal force produced by the drive plate is canceled by a balancing mass provided on the armature of the solenoid clutch.

Unbalance of centrifugal force acting on the main shaft is caused partly by rotation of rotational members such as the drive plate fixed to the main shaft and the swash plate main part connected to the drive plate in a tilted posture and partly by precessional motion of the piston support which is carried by the swash plate main part. The centrifugal force acting on the drive plate is unchanged regardless of the angle of tilt of the swash plate main part. However, the centrifugal force acting on the swash plate main part varies according to the tilting angle. In addition, an unbalance of force is also generated as a result of rotational movement of the gravity center of the piston support about the axis of the main shaft, and this unbalance of force also varies according to the tilting angle. Consequently, the composite centrifugal force composed of these force components varies according to the tilting angle of the swash plate main part. According to the first aspect of the invention, the swash plate main part is so constructed that its center of gravity is located substantially on the axis of the main shaft so as to minimize the variable of the centrifugal force caused by a change in the tilting angle. According to the second aspect, the center of gravity of the piston support is positioned substantially on the center of tilt of the swash plate main part so that the centers of gravity of both the swash plate main part and the piston support are located substantially on the axis of the main shaft, whereby the unbalance of the centrifugal force is minimized, and the rate of change in the unbalance of the centrifugal force in relation to a change in the tilting angle is made smaller.

It is thus possible to reduce the amount of unbalance of centrifugal force over the entire region of tilting angle of the swash plate main part, i.e., over the entire range of displacement of the compressor, thus reducing noise and vibration in the exterior and interior of automobile compartment, particularly when the engine is idling.

It is also possible to adjust the tilting angle at which the centrifugal force acting on the main shaft is reduced to zero, by suitably selecting the value of the additional mass added to the drive plate.

DESCRIPTION OF THE PREFERRED EMBODIMENTS

Figure 1:
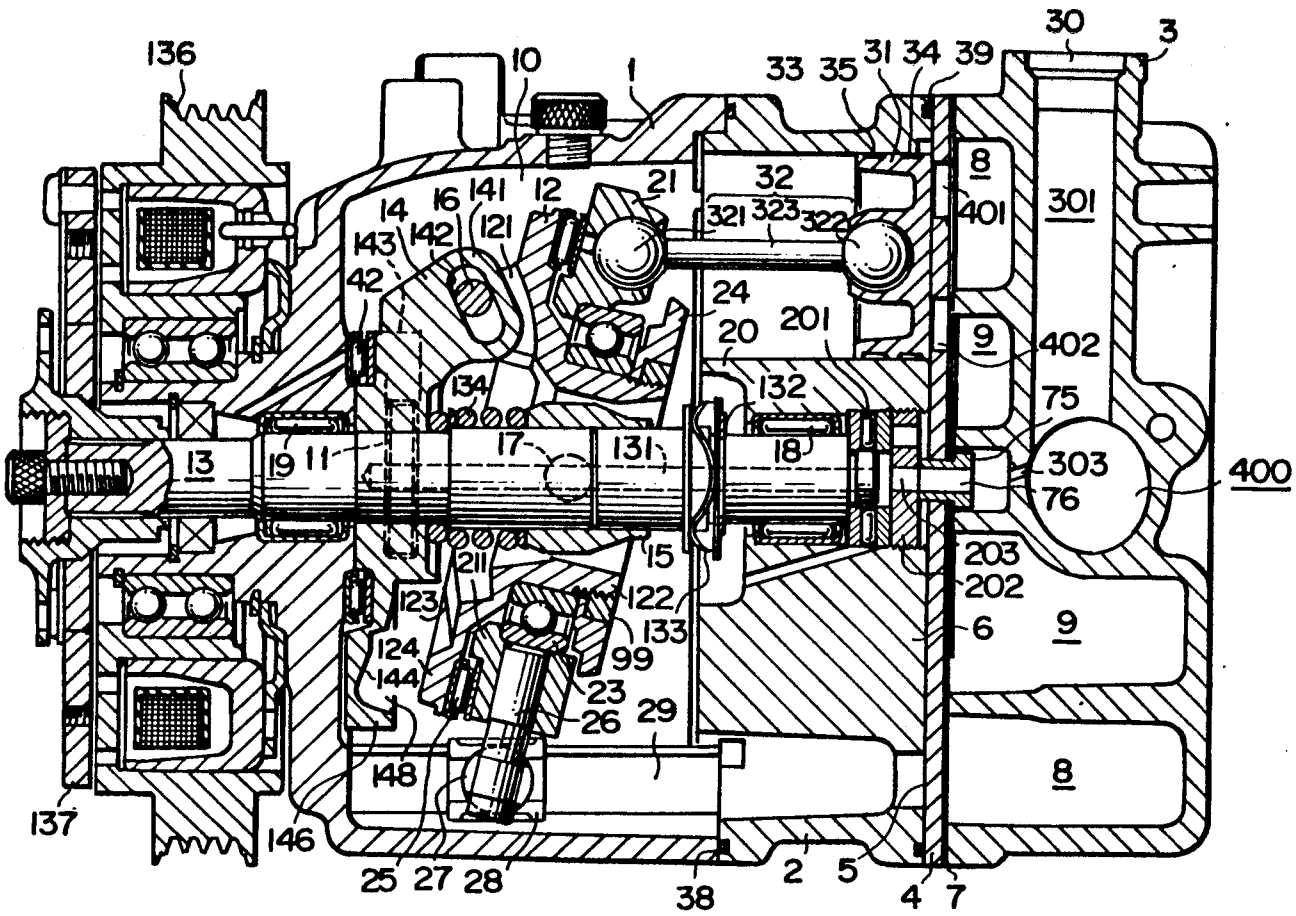
FIG. 1 is a longitudinal sectional view showing the structure of a first embodiment of the variable displacement swash plate type compressor in accordance with the present invention.

Referring now to the drawings wherein like reference numerals are used throughout the various views to designate like parts and, more particularly, to FIG. 1, according to this figure, a variable displacement. swash plate compressor embodying the present invention including a swash plate tilted to the maximum tilting angle to maximize the piston stroke comprises a housing including a cylindrical cylinder block 2 and a bowl-shaped front housing 1 fixed to one end of the cylinder block 2. A main shaft 13 is rotatably supported in the center of the front housing 1 and the cylinder block 2 through radial needle roller bearings 18 and 19. A swash plate chamber 10, receiving a swash plate to be described later, is defined in the front housing 1. A plurality of cylinders 33 are arranged within the cylinder block 2 around the main shaft 13 and extend in the axial direction of the main shaft 13.

A drive plate 14 is fixed to the main shaft 13 by a pin 11 or a plastic deformation coupling. The drive plate 14 forms a part of the swash plate composed of the drive plate 14 and a swash plate main part 12. The swash plate main part 12 is tiltable to various tilting angles by the following arrangement, so as to change the strokes of pistons received in the above-mentioned cylinders thereby varying the compressor displacement. The drive plate 14 has a lug 141 in which is formed a cam groove 142 which displaceably receives a pivot pin 16 provided on the swash plate main part 12. A pair of trunnions 121 formed on the swash plate main part 12 slidingly receive therebetween the lug 141 of the drive plate 14. The arrangement is such that, as the drive plate 14 rotates in accordance with the rotation of the main shaft 13, torque is applied to the trunnions 121 from the lug 141 of the drive plate 14 so that the swash plate main part 12 is driven to rotate. The cam groove 142 formed in the drive plate 14 has a curved edge which forms a closed loop. The curvature of the edge of the cam groove 142 is so determined that the position of the top dead center of each piston 31 is unchanged regardless of the movement of the pivot pins 16 in the cam groove 142.

A sleeve 15, which axially slidingly fits on the main shaft 13, is connected to the swash plate main part 12 by a sleeve pin 17 such that the swash plate main part 12 is rotatable about the sleeve pin 17 with respect to the sleeve 15. The arrangement is such that the angle of tilt of the swash pate main part 12 decreases as the sleeve 15 slides to the right as viewed in FIG. 1. The drive plate 14, the swash plate main part 12 and the sleeve 15 rotate as a unit in accordance with rotation of the main shaft 13. Thus, the sleeve pins 17 provide the center of tilt of the swash plate main part 12.

A piston support 21 is held on the swash plate main part 12 through a ball bearing 23. A balance ring 24 is fixed to a nose portion 122 of the swash plate main part 12 by a retainer ring 22 so as to pre-load the ball bearing 23 and prevent the ball bearing 23 from rotating relative to the swash plate main part 12.

The piston support 21 has a protrusion 211 which abuts against a part of the ball bearing 23 so as to prevent the piston support 21 from moving to the right as viewed in FIG. 1. The piston support 21 is also prevented from moving to the left by a thrust bearing 25 which is interposed between the swash plate main part 12 and the piston support 21. A support pin 26 is fixed to a lower portion of the piston support 21 by being press-fitted or screwed radially inwardly or by a plastic-deformation coupling. The support pin 26 has a slide ball 27 and carries a slide shoe 28 having a spherical inner peripheral surface fitting on the slide ball 27 and a cylindrical outer peripheral surface. The support pin 26 is therefore rotatable and slidable in an axial groove 29 which is formed in an inner peripheral bottom portion of the front housing. Consequently, the piston support 21 is prevented from rotating about the main shaft 13.

The compressor has a plurality of connecting rods 32 each having a central stem 323 and end ball portions 321 and 322 connected by, for example, welding to both ends of the stem 323. The ball 321 on one end of each connecting rod 32 is supported by the piston support 21 such that the connecting rod 32 is pivotable about the center of the ball 321. The other end of the connecting rod 32, i.e., the ball 322, also is received in a spherically shaped support portion behind each piston 31 by, for example, caulking, such that the connecting rod 32 is pivotable about the center of the ball 322 with respect to the piston 31. It will be understood that the compressor employs a plurality of assemblies each including the connecting rod 32 and the piston 31.

The pistons 31 are received in the aforementioned cylinders 33 formed in the cylinder block 2 for reciprocating movement in these cylinders 33. Each piston 31 has piston rings 34 and 35.

A suction valve plate 5, a cylinder head 4, a discharge valve plate 6, a packing 7 and a rear cover 3 are provided on the right end of the cylinder block 2 as viewed in FIG. 1. The cylinder block 2 is integrally fixed to the front housing by, for example, tie bolts (not shown). An O ring 38 is disposed between the joint surfaces of the front housing 1 and the cylinder block 2 to form a gas-tight seal therebetween. Similarly, an O ring 39 is provided between the rear cover 3 and the cylinder block 2 to form a gas-tight seal.

The rear cover 3 is provided with a suction port 30 and a discharge opening (not shown). The suction port 30 communicates with the suction passage 301 and leads to a suction chamber 8 via a control valve 400. Each cylinder 33 is provided with a suction port 401 and a discharge port 402 formed in the cylinder head 4. The suction port chamber 8 and the discharge chamber 9 are communicated with the suction ports 401 and the discharge ports 402, respectively, via the suction valve plate 5 and the discharge valve plate 6.

The swash plate chamber 10 in the front housing 1 is communicated with a space upstream of the control valve 400 through a communication passage 303 formed in the rear cover 3, a communication passage 76 formed in a stopper pin 75, a communication passage 203 formed in the center of a screw member 202, a passage 131 extending through the main shaft 13, and a passage 143 connected to the passage 131 and radially extending through the drive plate 14, whereby an equal pressure is maintained in the swash plate chamber 10 and the above-mentioned space. On the other hand, a space downstream of the control valve 400 communicates with the suction chamber 8.

Figure 2:
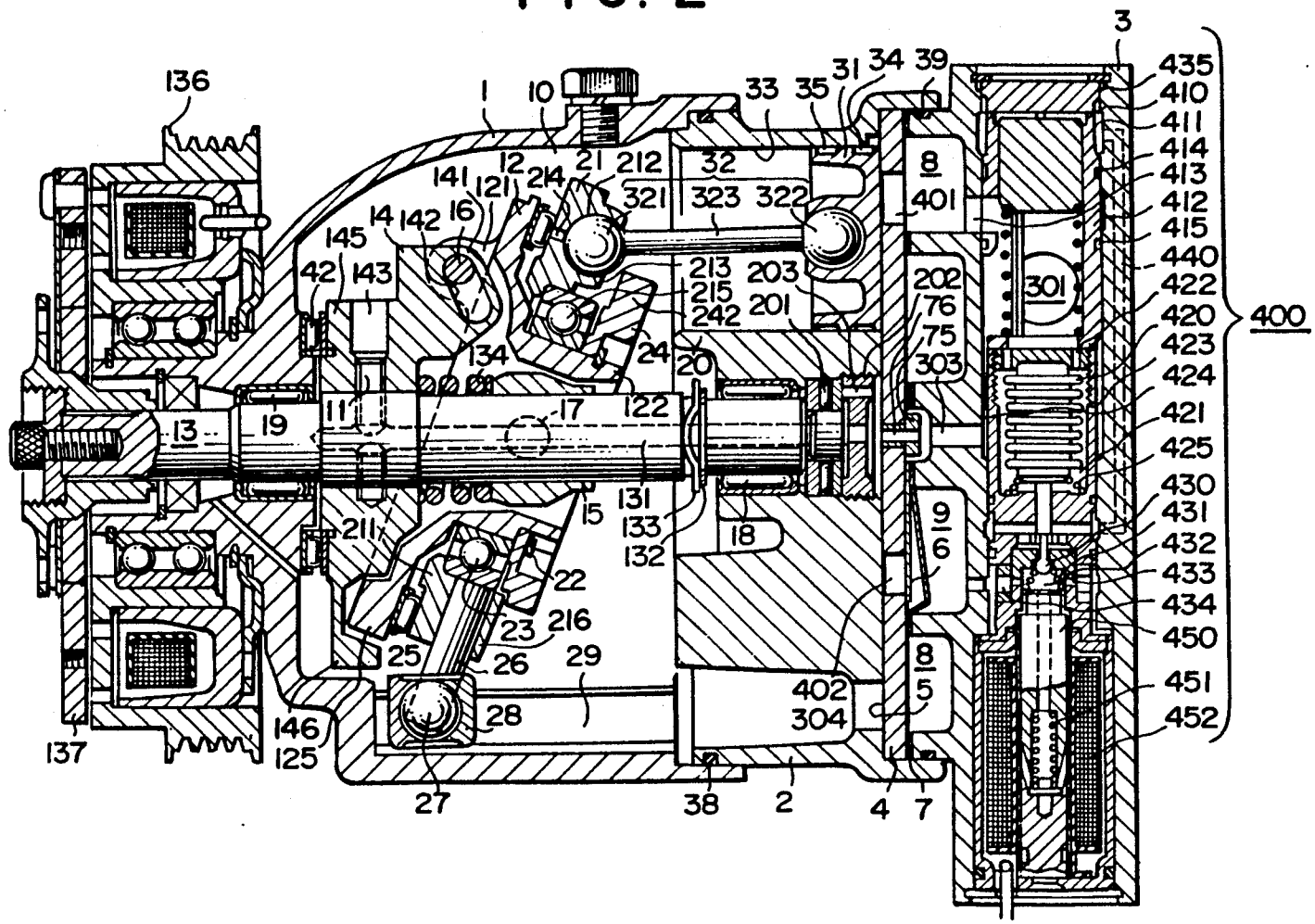
FIG. 2 is a longitudinal sectional view of another embodiment of the variable displacement swash plate type compressor in accordance with the present invention.

The control valve 400 may be of the type which is controlled externally or may be of a type shown in FIG. 2.

As shown in FIG. 2, the control valve 400 includes a piston-type main valve 410 is disposed in a flow passage between a suction passage 301 and the suction chamber 8 and disposed in a main valve case 411 together with a main valve spring 412. The main valve case 411 is hermetically fixed in a bore formed in the rear cover 3 with O-rings 414 and 415 placed between the main valve case 411 and the wall of the bore and is held in the bore by means of a lid 435. The main valve case 411 cooperates with the main valve 410 to define a passage 413 downstream of the control valve. The main valve spring 412 urges the main valve 410 for greater degree of opening of the main valve 410. A bellows chamber 421 receiving a bellows 420 is disposed on the other side of the main valve spring 412. The bellows chamber 421 communicates with the suction passage 301 through an equalizer port 422. An equalizer passage 424 is formed between the outer wall of the case 423 and the rear cover 3 and is in communication with the communication passage 303. Consequently, the pressure in the swash plate chamber 10 and the pressure in the bellows chamber 421 are maintained at an equal level which is the same as in the suction pressure of the compressor.

A pilot valve 430 is biased toward the bellows 420 by a pilot valve spring 431. A bellows spring 425 acts on the bellows 420 in such a direction as to contract the bellows 420. A plunger 450 having a head spring 451 is disposed on the side of the pilot valve spring 431 opposite to the pilot valve 430. A solenoid coil 452 is formed so as to surround the plunger 450.

The pilot valve chamber 432, in which the pilot valve 430 is provided, communicates with the discharge chamber 9 through communication bores 433, 434 and 304. The pilot valve chamber 432 also communicates with a space on the head of the main valve 410 through a communication passage 440 via the pilot valve 430.

To effect control of the compressor displacement, when the thermal load on the evaporator (not shown) of a refrigeration cycle is reduced, the refrigerant pressure at the suction side of the compressor, i.e., the pressure in the suction passage 301, decreases to allow the bellows 420 to expand. Consequently, the pilot valve 430 is opened so that the discharge pressure in the pilot valve chamber 432 acts on the head of the main valve 410 through a communication passage 440, thereby pressing the main valve 410 in a downward direction. Consequently, the passage 413 of the refrigerant is restricted by the control valve, so that the pressure in the suction chamber 8, i.e., the pressure in the space immediately upstream of the suction port 401, is reduced. Consequently, the pressure differential across the piston 31, i.e., the difference between the pressure in the swash plate chamber 110 and the pressure immediately upstream of the suction port 401, increases to reduce the angle of tilt of the swash plate and, accordingly, the piston stroke.

Conversely, when the thermal load on the evaporator has been increased, the suction pressure is increased to contract the bellows 420, thereby closing the pilot valve 430. Consequently, the pressure acting on the head of the main valve 410 decreases to increase the degree of opening of the passage at the control valve, pressure in the passage 413 downstream of the control valve increases to reduce the pressure differential across the piston 31, whereby the stroke of the piston 31 is increased. The external control of the displacement of the compressor is conducted by controlling the suction pressure of the compressor by varying the level of the voltage applied to the solenoid coil 52 in accordance with an external signal, e.g., temperature and pressure. For instance, when a large cooling power is required for rapidly cooling the air in, for example, a vehicle passenger compartment, the voltage applied to the solenoid coil 452 is lowered so that the attracting force imparted to the plunger 450 is decreased thereby resulting in a pressing load on the head spring 451 increasing to close the pilot valve 430. Consequently, the main valve 410 is fully opened to allow the compressor to operate with the maximum piston stroke, i.e., maximum displacement, so that the suction pressure in the compressor is decreased to increase the flow rate of the refrigerant. When the angle of tilt of the swash plate is being increased, the sleeve 15 slides along the main shaft 13 from the right to the left as viewed in FIG. 1. Consequently, the swash plate main part 12 rotates clockwise about the sleeve pin 17, until the swash plate is tilted to the maximum tilting angle thereby maximizing the piston stroke.

A pair of tilt limiting portions 123 are provided on the swash plate main part 12 at positions which are on the side of the main shaft 13 opposite to the trunnion 121 and which are in axis-symmetry with each other. The tilt limiting portions 123 are adapted to abut tilt limiting portions 144 of the drive plate 14 thereby determining the maximum tilting angle, i.e., the maximum displacement position. The swash plate main part 12 has a disk portion 124 which receives the thrust load generated as a result of compression of the refrigerant gas. The point on which the thrust load is applied moves on the surface of the disk portion 124 while the level of the thrust load is varied. The point on which the thrust load acts is spaced from the axis of the main shaft 13. Therefore, a moment is generated to cause the swash plate main part 12 to rotate about an axis y corresponding to the line VI—VI in FIG. 5. The moment increases as the displacement of the compressor increases. That is, the greatest moment is applied when the swash plate is at the maximum tilting angle.

Conventionally, two measures have been taken to bear the above-mentioned moment: namely, bearing the moment by the drive plate 14 and the sleeve 15, and receiving the moment by the drive plate 14 and the swash plate main part 12 only at a point on the axis. Consequently, problems have been encountered, such as abnormal wear of the sleeve pin receiving hole or breakdown of the sleeve 15. According to the invention, however, these problems are overcome by virtue of the above-described structure for limiting the maximum displacement. Namely, according to the invention, the reaction force produced by the above-mentioned moment is borne at two positions which are axis-symmetrical with respect to the y axis and which are largely spaced from the center of the main shaft 13 at the side of the main shaft opposite to the trunnion 121. Consequently, the reaction force can be remarkably decreased to enable a stable support, thereby eliminating the above-described problems encountered with the known compressor.

When the compressor is set for the maximum displacement, a suitable clearance remains between the sleeve 15 and the drive plate 14, as well as between the pivot pin 16 and an upper portion of the cam groove 142, thereby eliminating direct contact between these parts. Conversely, when the compressor is set for the minimum displacement, i.e., minimum piston stroke, with the swash plate tilting angle set to the minimum angle, the right end of the sleeve 15 as viewed in the drawings contact the stopper ring 132 and the spring member 133 on the main shaft 13, thus determining the minimum stroke position. A spring 134 provided on the main shaft 13 to act between the drive plate 14 and the sleeve 15 serves to urge the sleeve 15 in the direction for minimizing the piston stroke, while the spring member 133, disposed between the sleeve 15 and the stopper ring 132, serves to urge the sleeve 15 in the direction for maximizing the piston stroke.

The leftward axial thrust force acting on the main shaft 13 during compression of the gas is transmitted through the drive plate 14 to a thrust bearing 42 provided between the drive plate 14 and the front housing 1 and, thus, is borne by the thrust bearing 42. On the other hand, radial force acting in the main shaft 13 is borne by two radial needle roller bearings 19 and 18 which are provided in the front housing 1 and in a bearing housing 20 formed in the cylinder block 2. A thrust bearing 201 is fixed in the bearing housing 20 in the cylinder block 2 by the spring member 202 so as to engage with the right end of the main shaft 13 as viewed in FIG. 1. The top clearance of the compressor, defined as the clearance between the top of the piston 31 and the suction valve plate 5 as measured when the piston is at the top dead center, is adjustable by varying the thickness of the thrust race used in the thrust bearing 42 and the clamping force of the screw member 202.

In the compressor having the described structure, as driving power is input to the main shaft 13 of the compressor from an engine (not shown), the drive plate 14 and the swash plate main part 12 rock as a unit, causing the piston supports to rotate about the pin 17. This rocking rotation is generally referred to as "precession" and resembles the action of the surface of a liquid in a circular container when a revolving motion is given to the liquid. As a result of this precession, the pistons 31 reciprocatingly move in the cylinders 33, i.e., linearly in parallel with the axis of the main shaft 13.

The refrigerant gas which has been returned to the compressor from the portion of the refrigeration cycle (not shown) upstream of the compressor is introduced into the suction opening 30 and, after a suitable pressure control performed by the control valve 400, is introduced into the suction chamber 8 so as to flow via the suction valve port 5 into the cylinders 33 in the suction phase, thus completing the suction stroke.

The refrigerant gas introduced into the cylinders 33 is compressed by the pistons 31 and discharged into the discharge chamber 9 in the rear cover 3 through the discharge port 402 and via the discharge valve plate 6, and is delivered to the portion of the refrigeration cycle downstream of the compressor.

Figure 3:
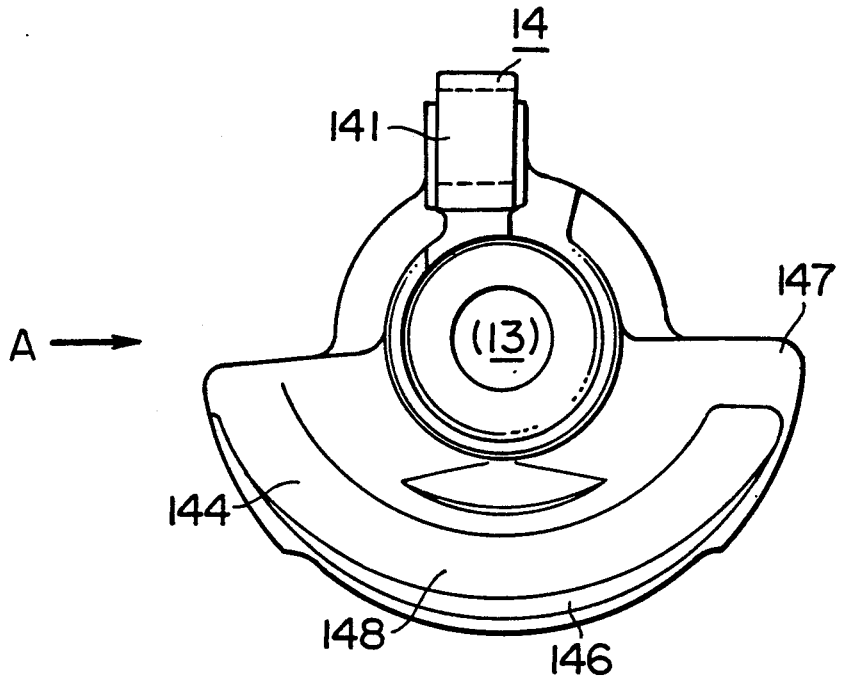
FIG. 3 is a front elevational view of a drive plate incorporated in the compressor shown in FIG. 1.
Figure 4:
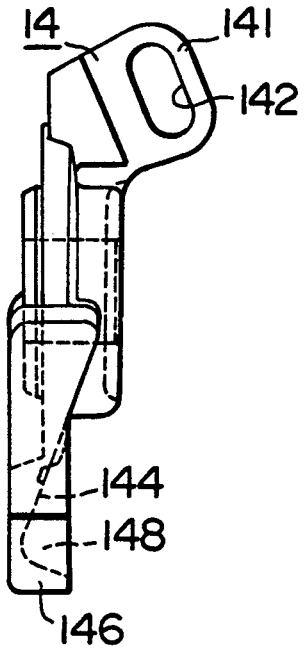
FIG. 4 is an illustration of the drive plate as viewed in the direction of an arrow A in FIG. 3.

As will be seen from FIGS. 3 and 4, the drive plate 14 is provided with the lug 141 having the cam groove or slot 142 formed therein. Referring to FIG. 3, the upward direction, the rightward direction, downward direction and the leftward direction with respect to the axis of the main shaft 13 are defined as +y direction, +x direction, −y direction and −x direction, respectively. The lug 141 with the cam slot 142 is located in the quarter which is determined by the +y and −x directions. A balance mass portion 147 is disposed at a position for substantially cancelling the mass unbalance produced by the lug 141 along the x-axis which is defined by the +x and −x directions. A balance mass portion 146 is provided such that the cancelling of the mass is shifted in the −y direction. The balance mass portion 146 has a sector-shape with a recess 148 capable of accommodating the disk portion 124 and the swash plate main part 12 when the tilting angle of the swash plate is maximum, i.e., when the compressor is set to provide the maximum displacement. A tilt limiting portion 144, which determines the maximum tilting position of the swash plate main part 12, is provided in the recess 148.

Figure 5:
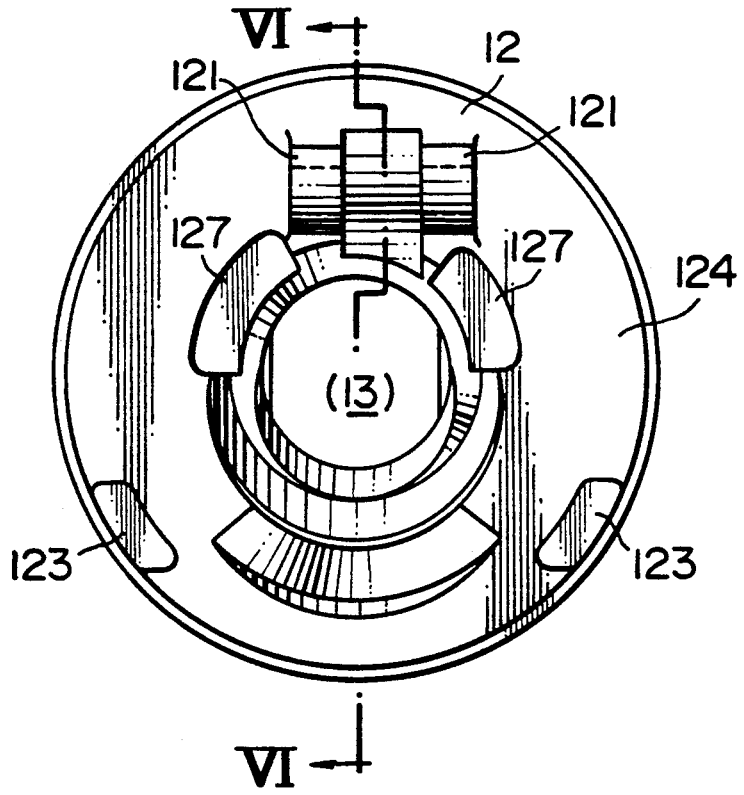
FIG. 5 is a front elevational view of a main part of a swash plate incorporated in the compressor shown in FIG. 1.
Figure 6:
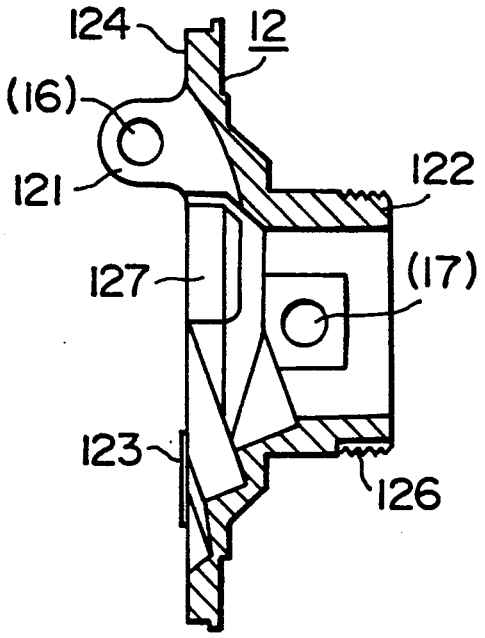
FIG. 6 is a sectional view taken along the line VI—VI of FIG. 5.

As shown FIGS. 5 and 6, the swash plate main part 12 has the nose portion 122 which rotatably carries the piston supports through the sleeve pin 17, a pair of trunnions 121, the disk portion 124 and the tilt limiting portion 123. The end of the nose portion 122 is threaded as at 126 for threadably mounting the balance ring 24. The balance ring 24 is fixed to the nose portion 122 by an adjusting nut 99 which also serves to pre-load the ball bearing 23.

The swash plate main part 12 is generally composed of a combination of a disk and a cylinder, except the trunnions 121. In order to reduce mass unbalance caused by the presence of the trunnions 121, a recess 127 is formed in a part of the disk portion 124 adjacent the trunnions 121.

Figure 7:
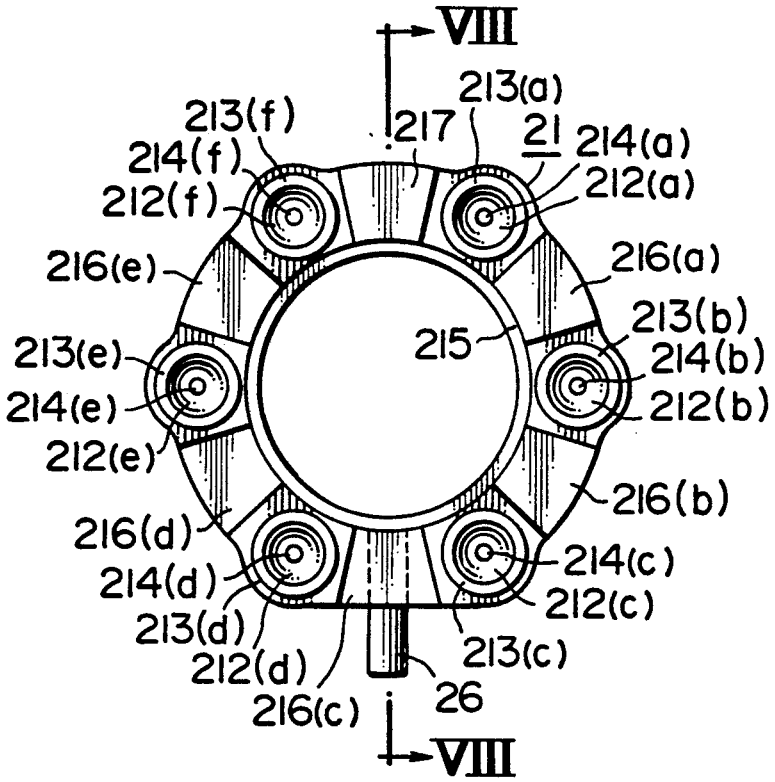
FIG. 7 is a front elevational view of a piston support.
Figure 8:
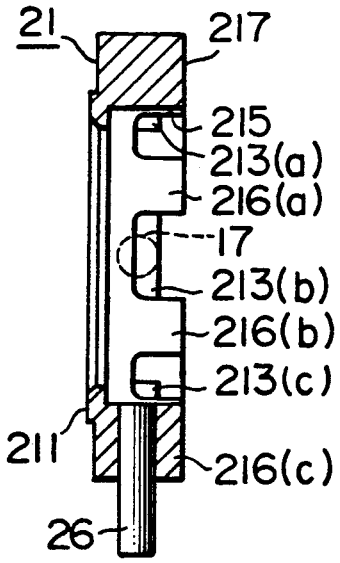
FIG. 8 is a sectional view taken along the line VIII—VIII of FIG. 7.
Figure 9:
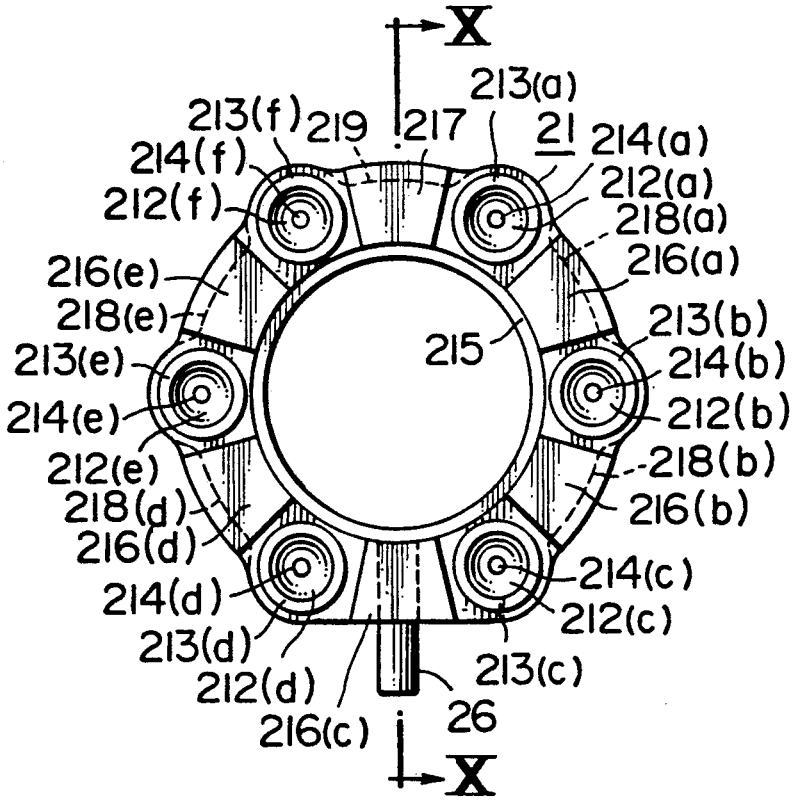
FIG. 9 is a front elevational view of a piston support incorporated in another compressor embodying the present invention.
Figure 10:
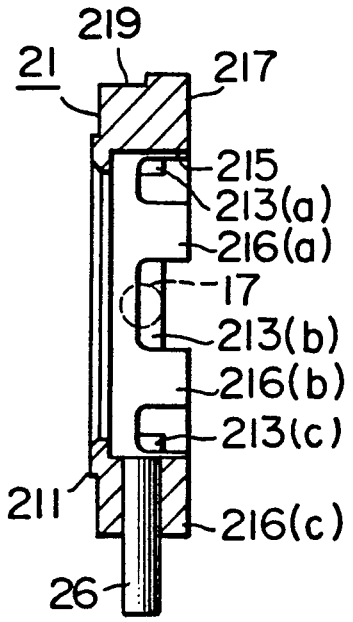
FIG. 10 is a sectional view taken along the line X—X of FIG. 9.

The following parts make a precessional rotation about the sleeve pin 17 in accordance with the rotation of the swash plate main part 12, namely, the piston support 21, the outer race of the ball bearing 23, the thrust race of the thrust bearing 25 adjacent the swash plate main part 12, and the rotation prevention mechanism composed of the support pin 26, slide ball 27 and the slide shoe 28. As shown in FIG. 7 and FIG. 8 as to FIG. 8 which is a sectional view taken along the plurality of recesses 212(*a*) to 212(*f*) for receiving the balls 321 on one ends of the connecting rods 32, collar portions 213(*a*) to 213(*f*), oil supply ports 214(*a*) to 214(*f*), a bearing housing portion 215 for receiving the outer race of the ball bearing 23, and the projection 211. Additional mass portions 216(*a*) to 216(*e*) and 217 are formed on the portions of the piston support 21 between the center of tilt of the swash plate main part 12, i.e., the axis of the sleeve pin 17, and the pistons 31. As a result of the provision of these additional mass portions 216(*a*) to 216(*f*), the center of the mass of the piston support, which otherwise will be offset from the axis of the sleeve pin 17 towards the drive plate 14 due to the presence of the recesses 212(*a*) to 212(*f*) and the projection 211, is located substantially on the axis of the sleeve pin 17. These additional mass portions 216(*a*) to 216(*f*) also provide a counter inertia which balances with the inertia produced by the rotation prevention mechanism (only the support pin 26 of this mechanism is shown in FIGS. 7 and 8). It will be clear that the additional mass portions 216(*b*) and 216(*d*) can be omitted if only the inertia produced by the rotation prevention mechanism is to be balanced. The additional mass portion 217 is formed and arranged in symmetry with the rotation prevention mechanism with respect to the axis of the main shaft. The additional mass portions 216(*a*) and 216(*d*) are in symmetry with each other with respect to the axis of the main shaft. Similarly, the additional mass portions 216(*b*) and 216(*e*) are in symmetry with each other with respect to the axis of the main shaft.

According to this arrangement, the center of the mass of the piston support is located on the axis of the sleeve pin 17 so that the unbalance of centrifugal force generated as a result of the precessional rotation of the piston support 21 can be substantially nullified, while the inertia produced by the rotation prevention member including the support pin 26 is materially balanced.

Recesses 218(*a*), 218(*b*), 218(*d*) and 218(*e*) are formed in the portions of the piston support 21 which are on the same side of the center of the sleeve pin 17 as the drive plate 14 and which are symmetrical with respect to the axis of the main shaft. A recess 219 is formed in a portion of the piston support 21 which is in symmetry with the support pin 26 with respect to the axis of the main shaft. These recesses 218(*a*) to 218(*e*) and the recess 219 serve to locate the center of the mass of the piston support 21 substantially on the axis of the sleeve pin 17, while reducing the mass of the piston support 21. The reduction in the mass of the piston support 21 serves to reduce the inertia of the reciprocating members including the piston support 21, thus improving the displacement control characteristic of the compressor.

Figure 11:
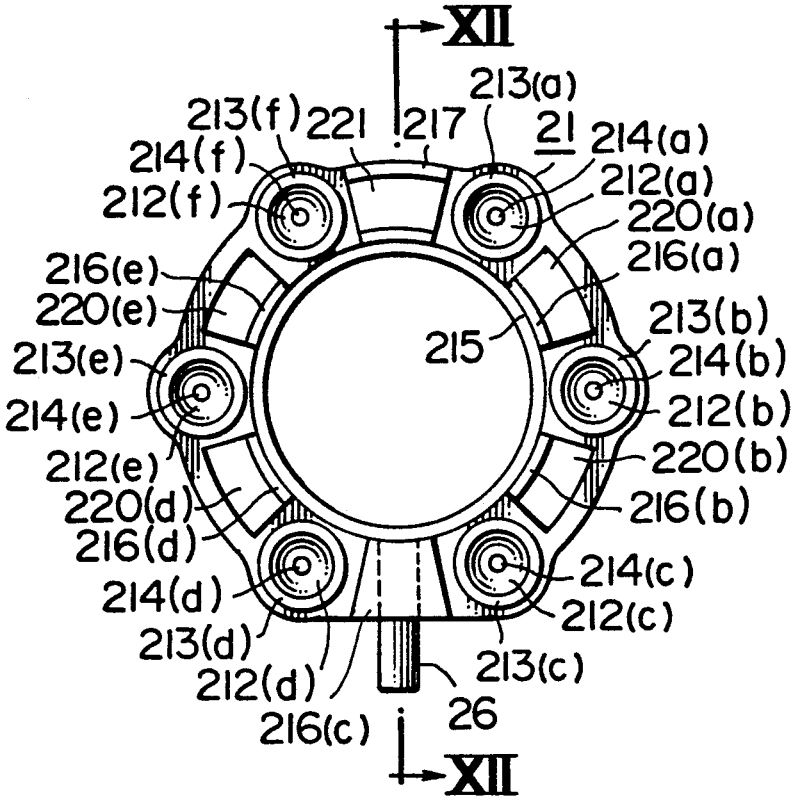
FIG. 11 is a front elevational view of a piston support incorporated in a still another compressor embodying the present invention.
Figure 12:
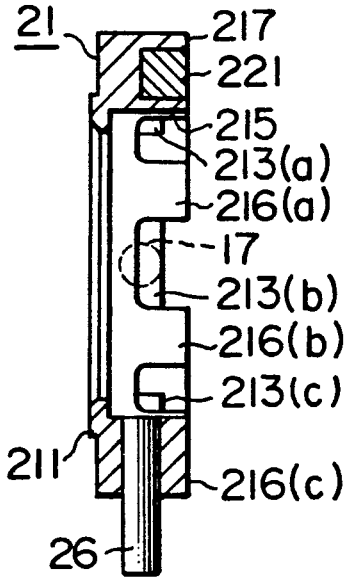
FIG. 12 is a sectional view taken along the line XII—XII of FIG. 11.

FIG. 11 is a front elevational view of a piston support incorporated in a different embodiment of the invention, while FIG. 12 is a sectional view taken along the line XII—XII of FIG. 11. In these Figures, the same reference numerals are used to denote the same parts or members as those in FIGS. 7 to 10, and detailed description of such parts or members is omitted.

Members 220(*a*), 220(*b*), 220(*d*), 220(*e*) and 221, having a greater specific gravity than the main part of the piston support 21, are provided on the portions of the piston support 21 which are on the same side of the axis of the sleeve pin 17 as the pistons 31, i.e., on the right end of the piston support 21 as viewed in FIG. 1. For instance, since the piston support 21 is usually formed from an aluminum alloy, the members 220(*a*), 220(*b*), 220(*d*) and 220(*e*) can effectively be formed by cast iron. The members 220(*a*) and 220(*d*) are provided in symmetry with respect to the axis of the main shaft. Similarly, the members 220(*b*) and 220(*e*) are disposed in symmetry with respect to the axis of the main shaft. The member 221 is provided in symmetry with the support pin 26 with respect to the axis of the main shaft.

In this embodiment, it is possible to adjust the position of the center of mass of the piston support comparatively easily by virtue of the use of members having comparatively large specific gravity.

In the embodiments described hereinbefore in connection with FIGS. 7 to 12, the piston support 21 is configured and constructed such that the position of center of the mass thereof coincides with the axis of the sleeve pin 17. This, however, is only illustrative and it is possible to design the compressor such that the axis of the sleeve pin 17 is located at the center of mass of the piston support 21. Preferably, the center of the sleeve pin 17 and the centers of the balls 321 are disposed on the expansion of the axis of the support pin 26.

Figure 13:
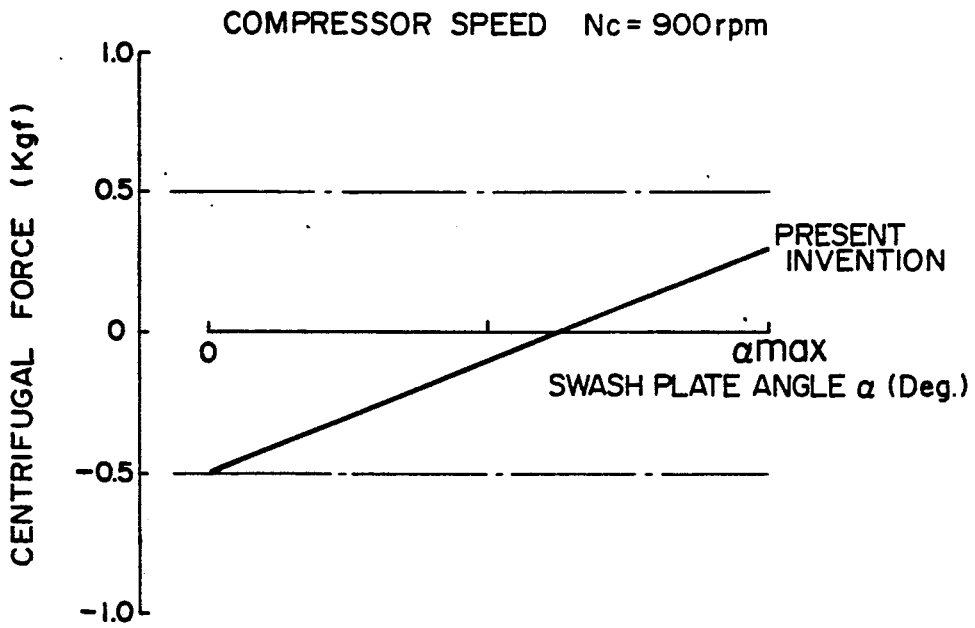
FIG. 13 is a diagram showing the relationship between the angle of tilt of a swash plate and centrifugal force in a compressor embodying the present invention.

The advantages of the embodiments of the invention described hereinbefore will be clearly understood from the following description with reference to FIG. 13 showing the relationship between the tilting angle $\alpha$ of the swash plate and the centrifugal force Fy obtained when a compressor of an embodiment of the invention operates at a speed Nc of 900 rpm. In this embodiment, the mass unbalance caused by the presence of the trunnions 121 on the swash plate main part 12 is compensated for by a recess 127 formed in a portion of the disk portion 124 on the same side of the main shaft as the trunnions 121, so that the swash plate main part has a reduced mass. As a result, the position of the center of the mass of the swash plate 12 is offset from the axis of the main shaft 13 as a result of tilting of the swash plate main part 12 but the inclination of the centrifugal force with respect to the tilting angle $\alpha$ is decreased.

It is also possible to shift the centrifugal force determined by the swash plate main part 12 towards the negative side, by employing a large balance mass portion 146 of the drive plate 14 as described before, as will be seen from FIG. 13.

In this embodiment, the balance of mass is attained by forming a recess in a part of the disk portion 124 adjacent the trunnion 121 without employing any additional mass, so as to further decrease the inclination of the centrifugal force with respect to the tilting angle of the swash plate, while the balance mass on the drive plate 14 is increased, whereby a smaller unbalance of centrifugal force is obtained in the maximum displacement operation than in the minimum displacement operation. Whether the smaller unbalance of centrifugal force is obtained in the maximum displacement state or in the minimum displacement state is determined freely by attaining the balance of the mass on the drive plate 14 or the solenoid clutch 137. In this embodiment, the smaller unbalance of centrifugal force is attained during operation of the compressor with the maximum displacement for the following reasons. In general, levels of vibration and noise of current automotive engines are extremely low when the engine speed is low, and the variable displacement compressor is usually driven by the automotive engine through a V-belt so that the operation speed of the compressor is substantially proportional to the engine speed. The displacement of the compressor varies according to the thermal load in the compartment of the automobile. In general, frequency of compressor operation with the maximum displacement is greater when the engine speed is low, e.g., during idling or when the automobile is in a traffic congestion, than when the automobile is cruising. Namely, the variable displacement compressor is very often operated in the maximum displacement condition at a low engine speed. For these reasons, it is preferred to design such that the smaller unbalance of centrifugal force is obtained during operation with the maximum displacement rather than during the operation with the minimum displacement. In this embodiment, the unbalance of centrifugal force is remarkably reduced not only in the direction of the y-axis but also in the direction of the x-axis.

The described embodiments of the embodiments are designed and constructed such that the position of the center of the mass of the piston support 21 substantially coincides with the center of the sleeve pin 17, as shown in FIG. 1. When the center of the mass, i.e., the gravity center, of the piston support 21 is offset from the center of the sleeve pin 17, an unbalance of an amount which is the product of the amount of offset and the weight of the piston support is generated as a result of the precessional rotation of the piston support 21. In the described embodiments of the invention, this unbalance is substantially nullified. Furthermore, the described embodiments are designed and constructed such that the extension of the axis of the support pin passes the centers of the balls 321 on the ends of the connecting rods 32 adjacent the piston support. This arrangement also contributes to the reduction in the unbalance caused by the precessional motion of the piston support 21.

Figure 14:
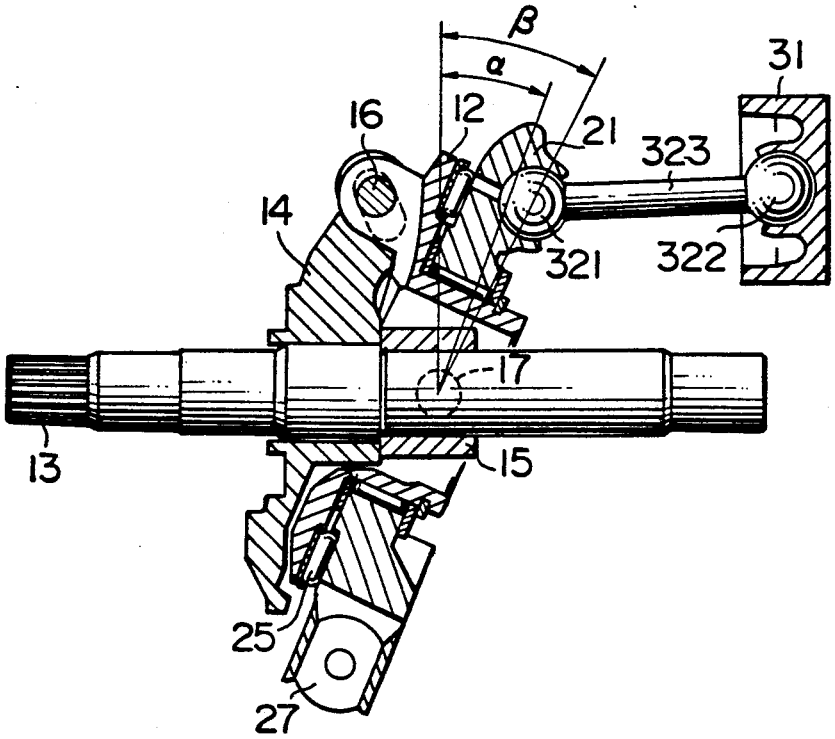
FIGS. 14 and 15 are axial sectional views of a critical portion of the compressor embodying the present invention, showing the relationship between angles $\alpha$ and $\beta$.
Figure 15:
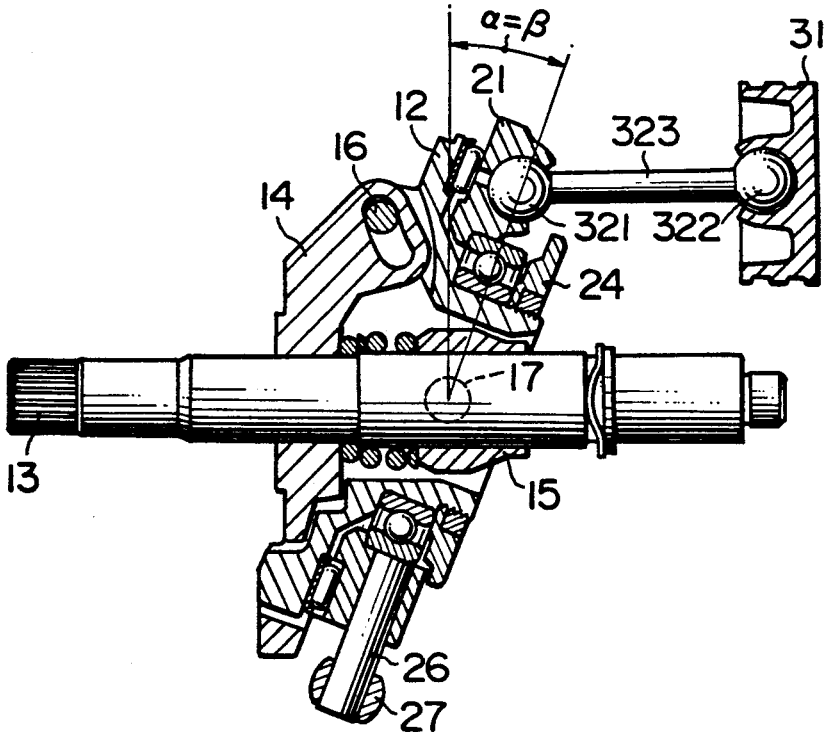

A description will now be made of the angle $\alpha$ of tilt of the swash plate and the angle $\beta$, with specific reference to FIGS. 14 and 15. The angle $\alpha$ of tilt of the swash plate is the angle of tilt of the axis of the swash plate main part 12 with respect to the axis of the main shaft 13, i.e., the angle formed between the swash plate main part 12 and a plane which passes the center of the sleeve pin 17 and which is perpendicular to the axis of the main shaft 13. On the other hand, the angle $\beta$ is the angle formed between the plane which passes the center of the sleeve pin 17 and which is perpendicular to the axis of the man shaft 13 and a line which interconnects the center of the sleeve pin 17 and the center of the ball 321 of the connecting rod 32. In FIG. 14, the angle $\alpha$ is smaller than the angle $\beta$, whereas, in FIG. 15, a condition $\alpha=\beta$ is met.

According to the invention, the positions of the additional masses or recesses to be provided on the piston support 21 are determined in accordance with the relationship between these angles $\alpha$ and $\beta$. Namely, when the angle $\alpha$ is equal to or smaller than the angle $\beta$8, additional masses are provided on the portions of the piston support 21 which are on the same side of the plane containing the center of the sleeve pin 17 and inclined at the same angle as the tilting angle of the swash plate as the pistons 31 or, alternatively, recesses are formed in the portions of the piston support which are on the side of the above-mentioned plane opposite to the pistons 31, i.e., on the side of the plate adjacent the drive plate 14.

Conversely, when the angle $\alpha$ is greater than the angle $\beta$, additional masses are provided on the same side of the above-mentioned plane as the drive plate or, alternatively, recesses are provided on the side of the above-mentioned plane adjacent to the pistons.

In the described embodiments of the variable displacement swash plate type compressor of the invention, the tilting angle of the swash plate is changed by reducing, by the control valve, the suction pressure at the inlet to the cylinder to a level below the pressure in the swash plate chamber which is maintained constant. This, however, is not exclusive and the invention can be carried out with other types of variable displacement swash plate type compressor, such as, for example, a compressor disclosed in Japanese Patent Publication No. 58-4195 in which blow-by gas or a part of the compressed gas is introduced into the swash plate chamber while the suction pressure is maintained constant, thereby effecting the control of the tilting angle of the swash plate.

The embodiments of FIGS. 16 to 21 show different forms of the drive plate 14, swash plate main part 12 and the balance ring 24.

Figure 16:
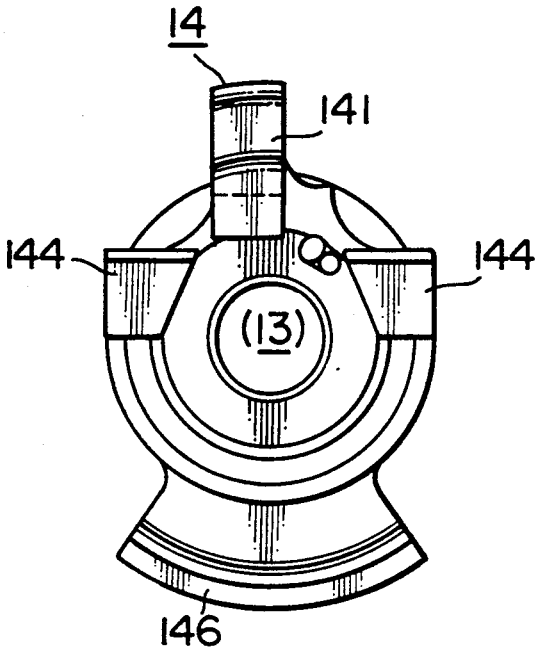
FIG. 16 is a front elevational view of a drive plate in a different embodiment of the present invention.

Referring to FIG. 16, the directions of the centrifugal force are determined such that the upward direction, the rightward direction, the downward direction and the leftward direction as viewed from the center of the main shaft 13 are respectively represented as +y direction, +x direction, −y direction and −x direction, respectively.

Figure 17:
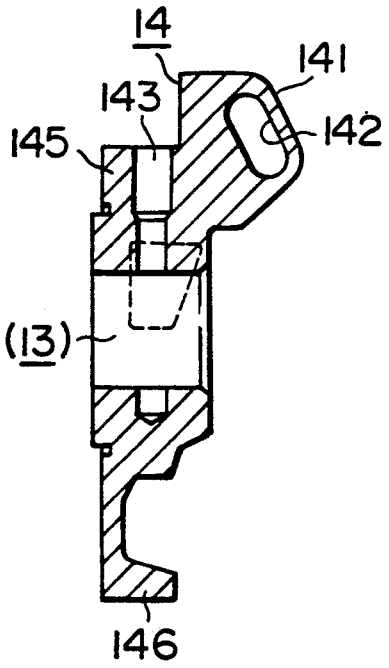
FIG. 17 is a cross-sectional view of the drive plate shown in FIG. 16.

Referring to FIGS. 16 and 17, the drive plate 14 has a trunnion 141 with a cam slot 142, a mass portion 145 for forming the communicating portion 143 and a tilt limiting portion 144 which are arranged on the portions of the drive plate 14 above the x-axis defined by the +x and −x directions, i.e., portions in the quarters spaced from the center of the main shaft 13 in the +y direction. On the other hand, a balance mass portion 146 is provided on a portion of the drive plate 14 which is spaced from the center of the main shaft 13 in the −y direction so as to produce a centrifugal force which balances the synthetic centrifugal force produced by the trunnion 141, the mass portion 145 and the tilt limiting portion 144. Balance of centrifugal force is also obtained in the x-axis direction determined by the +x and −x directions. Thus, a balance of centrifugal force is obtained on the drive plate 14 as a single member.

Figure 18:
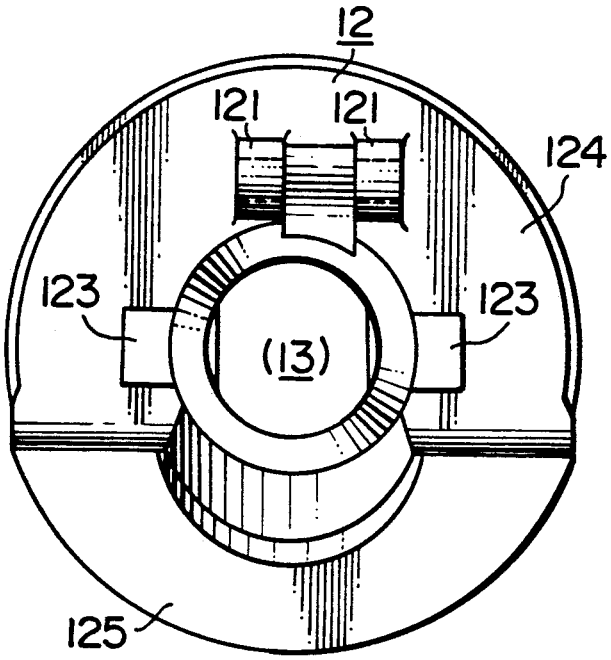
FIG. 18 is a front elevational view of a main part of a swash plate incorporated in a different embodiment of the present invention.
Figure 19:
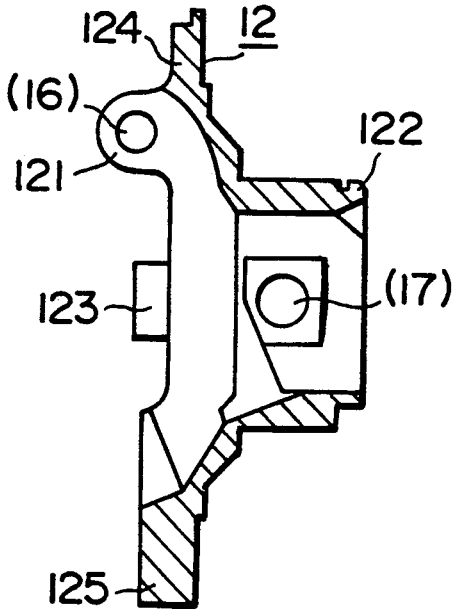
FIG. 19 is a cross-sectional view of the main part of swash plate shown in FIG. 18.

Referring to FIGS. 18 and 19, a swash plate main part 12 has a nose portion 122 for rotatably supporting the sleeve pin 17, trunnions 121, a disk portion 124, a tilt limiting portion 123 and an additional mass portion 125. As will be seen from FIG. 19, an eccentric mass 125 is constituted by a semi-circular portion provided on a part of the disk portion 124 opposite to the trunnions 121 and having an outer peripheral edge defining the edge of the disk portion 124. As will be seen from FIG. 2, the eccentric mass portion 125 is so shaped as to be received in a space defined by the inner peripheral edge of the balance mass portion 146 of the drive plate 14 and the front housing 1. Since the swash plate 12 is formed substantially symmetrically in the +x and −x directions with respect to the axis of the main shaft 13, the centrifugal force substantially balances in the direction of the x-axis. However, in the direction of the y-axis, the centrifugal force varies in accordance with the angle of tilt of the swash plate because of the tilt of the swash plate main part 12.

Figure 20:
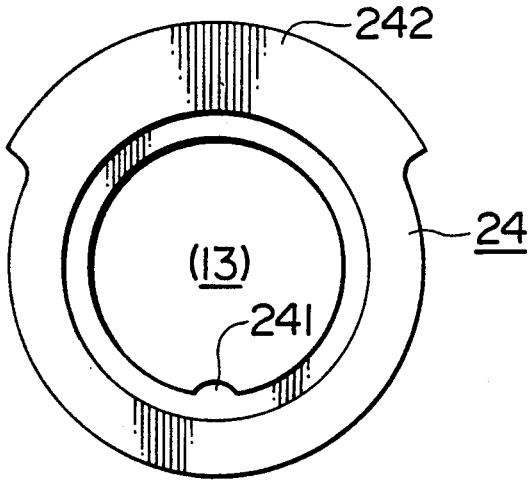
FIG. 20 is a front elevational view of a balance ring incorporated in an embodiment of the present invention.
Figure 21:
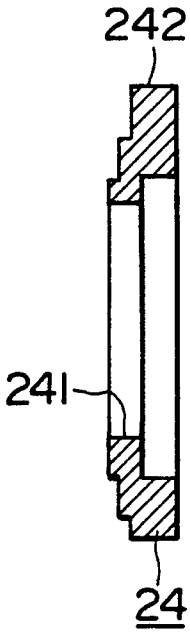
FIG. 21 is a cross-sectional view of the balance ring shown in FIG. 20.

Referring now to FIGS. 20 and 21, the balance ring 24 is provided with a projection 241 for locating the balance ring 24 on the nose portion 122 of the swash plate main part 12. In addition, an eccentric mass portion 242 is provided on a portion of the balance ring 24 which is spaced from the axis of the main shaft 13 in the +y direction, i.e., at the same side of the axis of the main shaft 13 as the trunnion 121 on the swash plate main part 12. The balance ring 24 has a structure which is symmetrical in the left and right directions with respect to the axis of the main shaft 13, so that the centrifugal force acting on the balance ring is balanced substantially perfectly in the direction of the x-axis. The centrifugal force acting on the balance ring 24 in the direction of the y-axis, however, varies according to the tilting angle because the eccentric mass portion 242 and the balance ring 24 are fixed to the swash plate main part 12.

Figure 22:
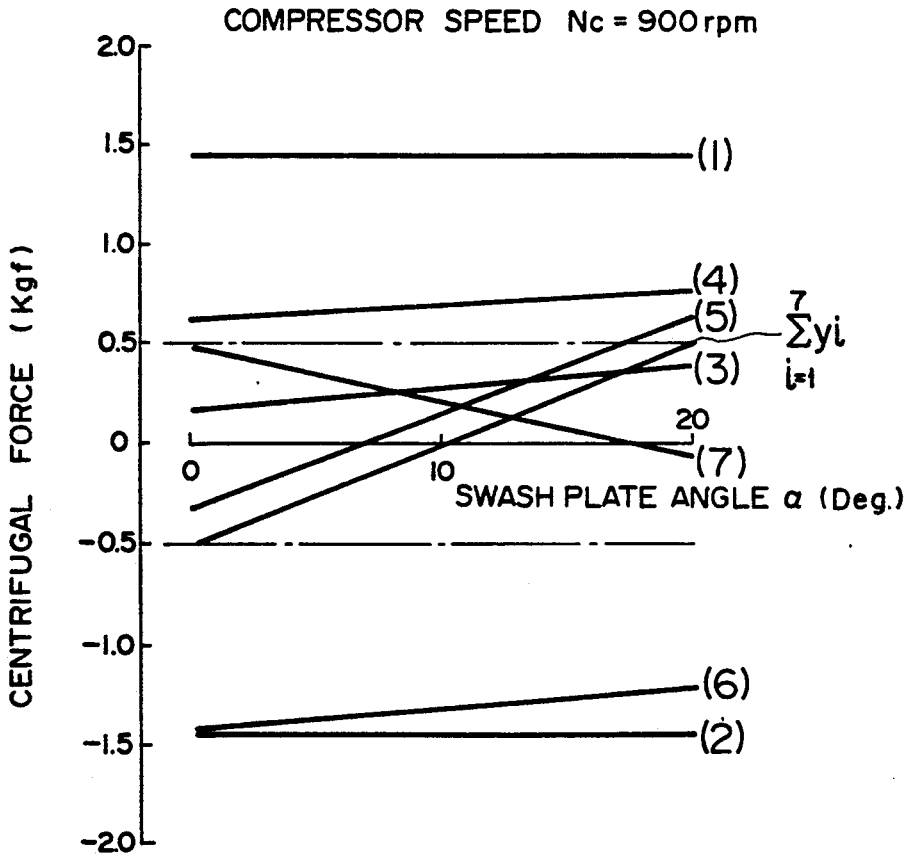
FIG. 22 is a graph showing the relationship between the angle of tilt of a swash plate and centrifugal force in a compressor embodying the present invention.

FIG. 22 shows the levels of the centrifugal forces Fy acting in the direction of the y-axis on each element of each of the components such as the drive plate 14, the swash plate main part 12 and the balance ring 24 in the described embodiment of the variable displacement swash plate type compressor of the invention when the compressor operates at a speed Nc of 900 rpm. More specifically, FIG. 22 shows the centrifugal forces at various tilting angles $\alpha$, more specifically, the centrifugal forces Fy on the drive plate 14 (shown by lines (1) and (2)), on the nose portion 122 of the swash plate main part 12 (line (3)), on the trunnions 121 and pivot pin 16 on the swash plate main part 12 (line (4)), on the disk portion 124 and the tilt limiting portion 123 of the swash plate main part 12 (line (5)), on the additional mass portion 125 of the swash plate main part 12 (line (6)), and on the balance ring 24 (line (7)). As explained before, the centrifugal forces Fx in the x-axis direction are substantially balanced. The lines (1) and (2) are flat regardless of the tilting angle. Namely, the levels of the centrifugal forces acting on the drive plate 14 are constant and meet the condition of $Fy1+Fy2=0$. The lines (3) to (6) and the line (7) have certain gradients with respect to the tilting angle $\alpha$. The sign and the value of the gradient vary according to the elements The composite centrifugal force Fy represented by Fy=

$$Fy = \left( \sum_{i=1}^{7} Fyi \right)$$

is 0.5 kgf at the maximum tilting angle $\alpha_{max}$ which is 20° in this embodiment and −0.5 kgf at the minimum tilting angle $\alpha_{min}$ which is 0°. The composite centrifugal force Fy is 0 at the mean tilting angle $\alpha_{mean}$ which is 10° in this embodiment. Thus, the drive plate 14, the swash plate main part 12 and the balance ring 24 are designed and constructed such that unbalance of the centrifugal force is substantially nullified when the swash plate is set to the mean tilting angle and yet the absolute values of the unbalance of the centrifugal force is 0.5 kgf or below when the compressor operates with the swash plate set to the maximum and minimum tilting angles.

In this embodiment, the maximum unbalance of the centrifugal force is set to be ±0.5 kgf through actual measurement, as well as evaluation through auditory sensing, of the levels of vibration and noise at the exterior and interior of an automobile compartment on which a model machine having an inertia mass on the main shaft 13 was installed, while the operation of the compressor was suspended. The values ±0.5 kgf of the unbalance of centrifugal force was the value obtained when the vibration of the engine itself is small. This value therefore changes according to the type of the engine to which the compressor is coupled.

Figure 23:
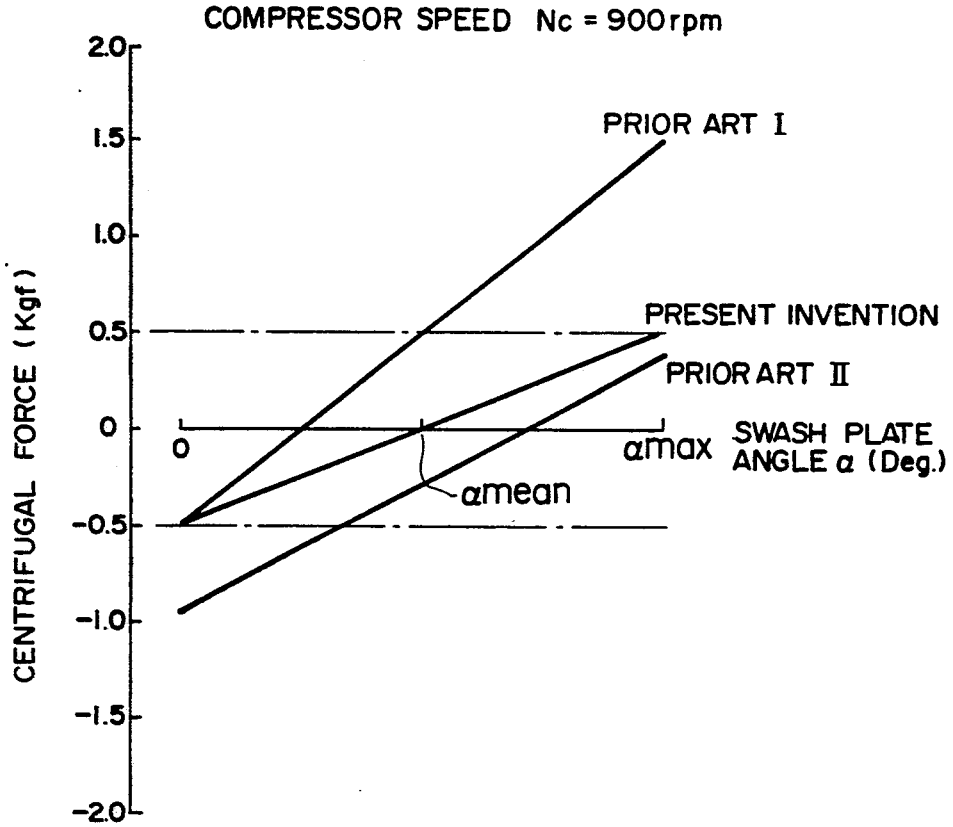
FIG. 23 is a graph showing the relationships between the angle of tilt of a swash plate and centrifugal force in a compressor embodying the present invention and in a known compressor.

FIG. 23 shows the composite centrifugal force Fy synthesized from the centrifugal force components produced by the respective rotary members in relation to the tilting angle α of the swash plate when the compressor speed Nc is 900 rpm, in comparison with those exhibited by known compressors I and II. In the case of the known compressor I, the composite centrifugal force Fy, i.e., the unbalance of the centrifugal force, is not greater than −0.5 kgf at the minimum tilting angle $\alpha_{min}$ of 0°, but the composite centrifugal force Fy exceeds 0.5 kgf when the swash plate is set to the maximum tilting angle $\alpha_{max}$. Consequently, the tilting angle α at which the composite centrifugal force Fy is reduced to zero is smaller than the mean tilting angle $\alpha_{mean}$ which is half the maximum tilting angle $\alpha_{max}$. This means that large unbalance of centrifugal force appears when the compressor operates with the maximum displacement or near y. Consequently, the levels of vibration and noise are increased both at the exterior and the interior of the automobile compartment due to the primary unbalance produced by the composite centrifugal force. In the known compressor II, the composite centrifugal force Fy is 0.5 kgf or smaller at the maximum tilting angle $\alpha_{max}$, but the composite centrifugal force exceeds 0.5 kgf at the minimum tilting angle $\alpha_{min}$ which is 0°. Consequently, the levels of the vibration and noise are increased due to primary unbalance of rotation caused by the composite centrifugal force when the compressor operates at the minimum displacement or nearby.

It would be possible to take a suitable measure for nullifying the composite centrifugal force Fy at the mean tilting angle $\alpha_{mean}$, so as to attach an additional mass to the armature of the solenoid clutch. Such a measure, however, merely causes a translational movement of the line indicating the level of the centrifugal force in FIG. 23 in an amount corresponding to the added mass and does not make any contribution to the reduction in the vibration and noise caused by the rotational primary unbalance caused by the centrifugal force.

Figure 24:
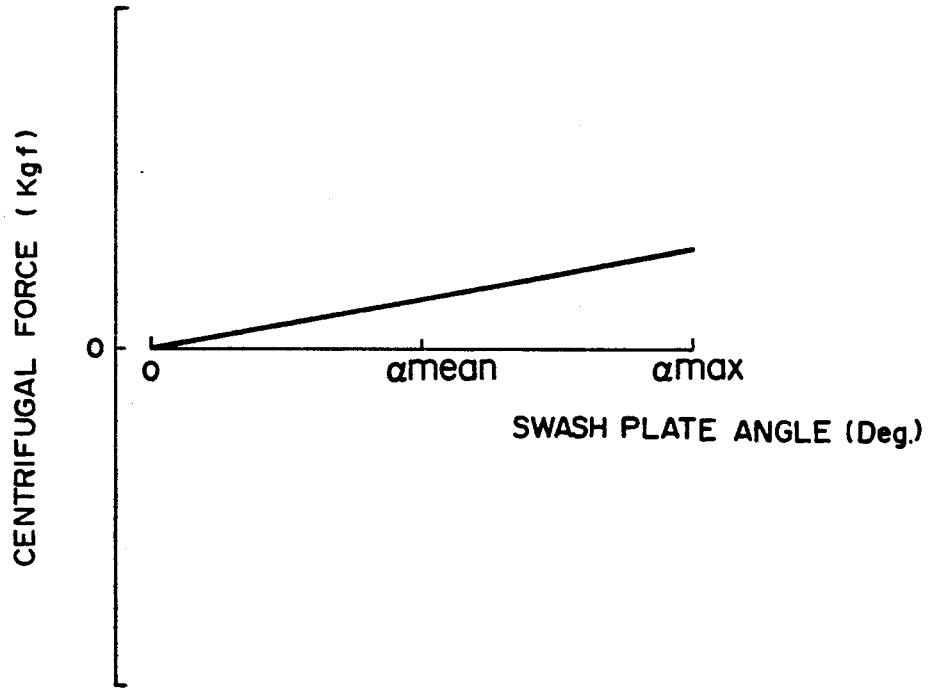
FIG. 24 is a graph showing the relationship between the angle of tilt of a swash plate and centrifugal force in a different compressor embodying the present invention.

FIG. 24 shows the characteristic of a compressor in which the drive plate and the swash plate main part are designed and constructed such that their masses are distributed to nullify the composite centrifugal force Fy when the tilting angle α is zero. In this case, the displacement control of the compressor is conducted when the compressor is operating at high speed, so that the swash plate is usually held at a small tilting angle. This compressor, therefore, offers a remarkable reduction in the vibration and noise particularly at high operation speeds of the compressor.

Figure 25:
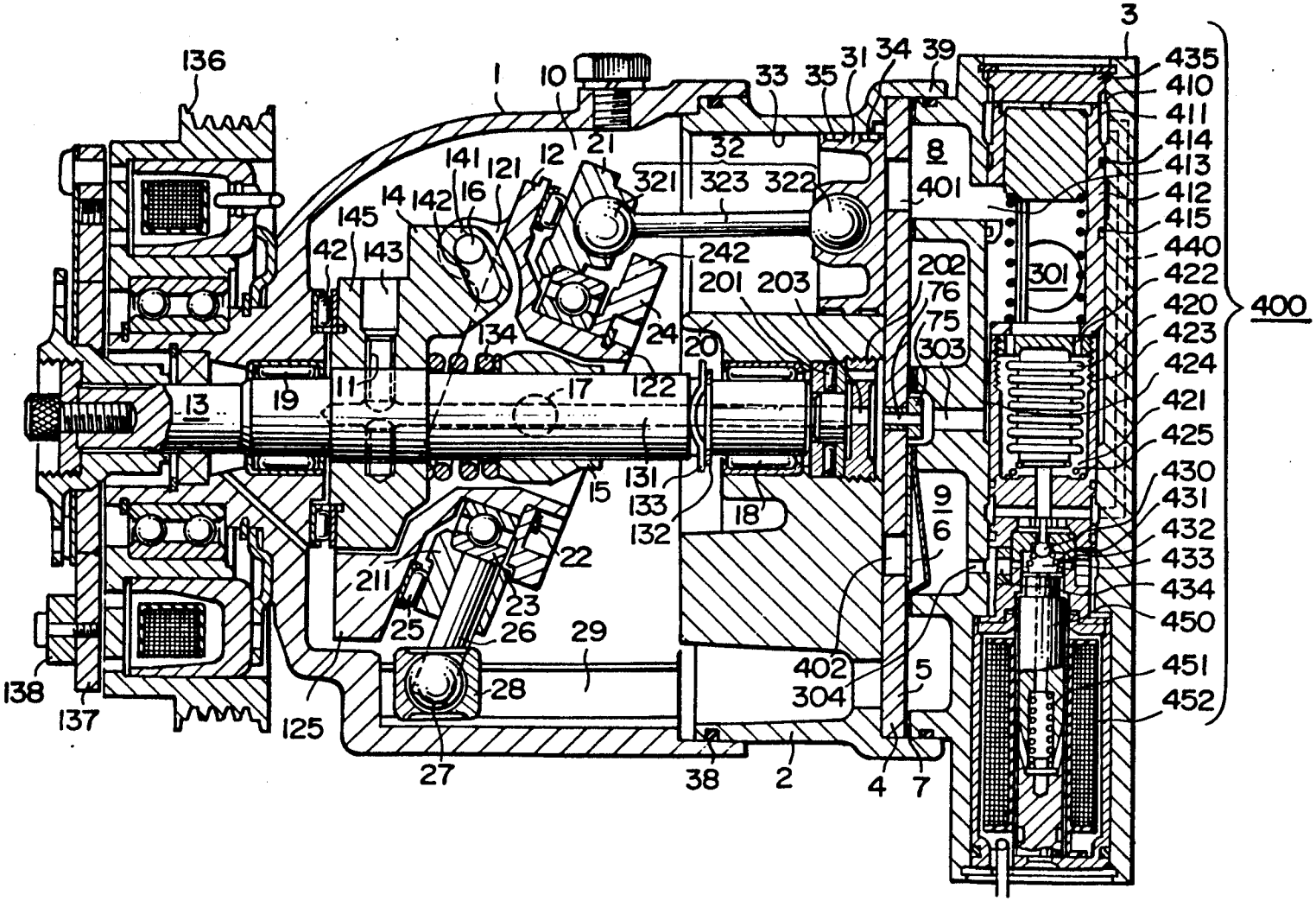
FIG. 25 is a variable stroke swash plate type compressor of a further embodiment of the present invention.

FIG. 25 shows a further embodiment of the variable displacement swash plate type compressor of the present invention. This embodiment differs from the embodiment shown in FIG. 1 in the following respects.

Namely, the embodiment of FIG. 25 lacks the balance mass portion 146 which is provided at a portion of the drive plate 14 below the axis of the main shaft 13 in the embodiment shown in FIG. 1. In FIG. 25, the additional mass portion 125 provided on the swash plate main part 12 is enlarged so as to be received in the space which, in the embodiment shown in FIG. 1, is occupied by the balance mass portion 46. The increased additional mass 125 serves to increase a counterclockwise moment which acts on the swash plate about the sleeve pin 17 so as to urge the swash plate 12 towards upright position, consequently, an unbalance of the centrifugal force is caused in the y-axis direction on the drive plate 14 as a single body. Namely, a centrifugal force +Fyd appears to act on the drive plate 14 only in the positive direction along the y-axis direction. Any influence of this centrifugal force Fyd, however, can be eliminated by providing an external mass 138 on the armature portion 137 of the solenoid clutch 136 so as to produce a centrifugal force −Fyd which cancels the above-mentioned centrifugal force Fyd.

The advantage of the embodiment shown in FIG. 25 will be described with reference to the relationship between the tilting angle α of the swash plate and the centrifugal force Fy as shown in FIG. 22. In FIG. 22, the line (2) represents the centrifugal force −Fyd produced by the above-mentioned external mass 138 provided on the armature 137. It will be seen that the advantages of the present invention are attainable even when an unbalance of centrifugal force remains on the drive plate 14 as a single body, provided that a suitable external mass is added to the solenoid clutch. Thus, the embodiment shown in FIG. 22 offers an advantage that the unbalance of the centrifugal force in the compressor can be adjusted from the exterior of the compressor and, in addition, even a delicate adjustment is possible. Furthermore, this embodiment produces an effect to reduce the control pressure differential in the control valve 400 in addition to the effect for reducing the vibration and noise produced by an unbalance of the centrifugal force.

In the embodiment shown in FIG. 25, the change in the tilting angle of the swash plate is effected by reducing, by the control valve, the pressure at the suction side of the cylinder to a level below the pressure in the swash plate chamber which is maintained constant. This, however, is only illustrative and the same advantage can be produced when the invention is applied to other types of variable displacement swash plate type compressor, such as the compressor disclosed in Japanese Patent Publication No. 58-4195 in which the control of tilting angle of a swash plate is effected by introducing blow-by gas or a part of the compressed gas into the swash plate chamber so as to increase the pressure in this chamber while the pressure at the inlet to the cylinder is maintained constant.

Figure 26:
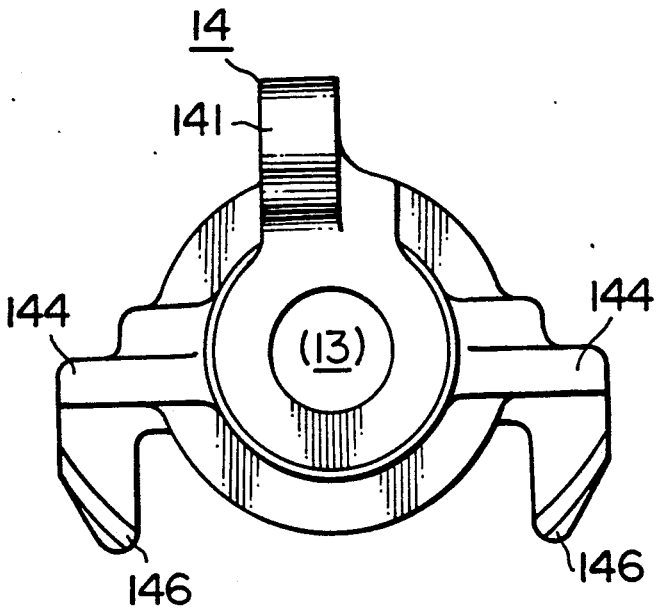
FIG. 26 is a front elevational view of a drive plate incorporated in the further embodiment of the invention.
Figure 27:
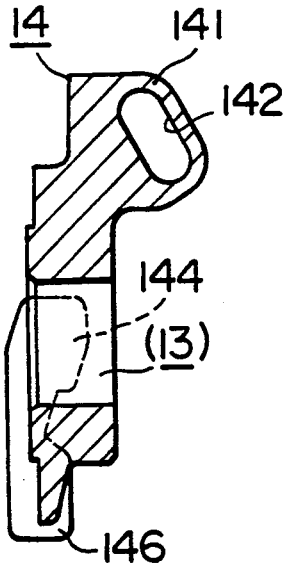
FIG. 27 is a cross-sectional view of the drive plate shown in FIG. 26.

FIGS. 26 and 27 show a still further embodiment in which unbalance of centrifugal force acting on the drive plate 14 is substantially nullified.

The drive plate 14 has a lug 141 which is provided with a cam groove or slot 142. The drive plate 14 also has balance mass portions 146 and tilt limiting portions 144 which are arranged to cancel the centrifugal force produced by the lug 141. The balance mass portions 146 have a wing-like structure with a central recess so that it does not interfer with an eccentric mass portion (not shown) formed on a lower end portion of the swash plate main part (not shown) when the swash plate main part is tilted to the maximum tilting angle. Thus, the balance mass portion is formed in such a manner as to surround the eccentric mass of the swash plate main part. Therefore, the eccentric mass is effectively added to the swash plate main part not only to reduce unbalance of the centrifugal force but also to increase a moment which acts to reduce the tilting angle of the swash plate main part.

It is therefore possible to achieve the aforementioned object of the present invention without requiring any increase in the size of the compressor in the axial direction of the main shaft.

As has been described, the present invention makes it possible to reduce vibration and noise of the body of an automobile equipped with the compressor of the invention over the entire range of the compression operation, by virtue of the fact that the rotational primary unbalance caused by precessional rotation of the piston support and associated members is reduced, as as the fact that the mass unbalance of the rotational parts of the compressor is minimized.

What is claimed is:

1. A variable displacement swash plate type compressor, comprising: a main shaft adapted to be driven by a driving power source; a drive plate fixed to the main shaft; a swash plate main part tiltable engaging through an engaging portion with the drive plate so as to be tiltable with respect to the axis of the main shaft and to make a precessional rotation in accordance with the rotation of the main shaft; a piston support rotatably carried by the swash plate main part so as to make a precessional rotation together with the swash plate main part; pistons having one ends engaging with the piston support so as to reciprocatingly move in respective cylinders in accordance with the precessional rotation of the swash plate main part; and means for causing a change in the angle of tilt of the swash plate main part with respect to the axis of the main shaft so as to effect a control of displacement, wherein the swash plate has a balancing portion which cancels an unbalance of mass produced about the axis of the main shaft by the engaging portion at a predetermined angle of tilt of the swash plate so as to locate the center of gravity of the swash plate main part substantially on the axis of the main shaft.

2. A variable displacement swash plate type compressor according to claim 1, wherein the balancing portion comprises a recess formed in a disk portion of the swash plate main part at a position which is on the same side of the axis of the main shaft as the engaging portion.

3. A variable displacement swash plate type compressor according to claim 1, wherein the balancing portion comprises a semi-circular additional mass portion provided on the portion of the swash plate main part which is on the side of the axis of the main shaft opposite to the engaging portion and extending along the outer peripheral edge of the swash plate main part.

4. A variable displacement swash plate type compressor according to claim 1, wherein an additional mass is provided on a portion of the drive plate which is on the side of the axis of the main shaft opposite to the engaging portion, the value of the additional mass being selected to adjust the angle of tilt of the swash plate main part at which an unbalance of the centrifugal force acting on the main shaft is substantially canceled.

5. A variable displacement swash plate type compressor according to claim 4, wherein the value of the additional mass is so determined that the tilting angle at which the unbalance of centrifugal force acting on the main shaft is canceled is set between the mean tilting angle and the maximum tilting angle of the swash plate.

6. A variable displacement swash plate type compressor according to claim 4, wherein the additional mass is provided such that the unbalance of centrifugal force acting on the main shaft is greater when the tilting angle of the swash plate is smaller than when the tilting angle is larger.

7. A variable displacement swash plate type compressor according to claim 4, wherein an additional mass is provided on the main shaft so as to cancel an unbalance of the centrifugal force produced as a result of rotation of the drive plate.

8. A variable displacement swash plate type compressor according to claim 1, wherein a balance ring having an additional mass is provided on a nose portion of the swash plate main part at the same side of the swash plate main part as the engaging portion.

9. A variable displacement swash plate type compressor according to claim 4, wherein the drive plate has a tilt limiting portion and the additional mass is provided on the tilt limiting portion.

10. A variable displacement swash plate type compressor, comprising: a main shaft adapted to be driven by a driving power source; a drive plate fixed to the main shaft; a swash plate main part tiltable engaging through an engaging portion with the drive plate so as to be tiltable with respect to the axis of the main shaft and to make a precessional rotation in accordance with the rotation of the main shaft; a piston support rotatably carried by the swash plate main part so as to make a precessional rotation together with the swash plate main part; pistons having one ends engaging with the piston support so as to reciprocatingly move in respective cylinders in accordance with the precessional rotation of the swash plate main part; and means for causing a change in the angle of tilt of the swash plate main part with respect to the axis of the main shaft so as to effect a control of displacement, wherein the swash plate main part is shaped such that an unbalance of mass of the swash plate main part produced about the axis of the main shaft by the engaging portion is cancelled so that the center of gravity of the swash plate main part is located substantially on the axis of the main shaft, and the center of gravity of the piston support is positioned substantially on the center of tilt of the swash plate main part.

11. A variable displacement swash plate type compressor according to claim 10, wherein the piston support includes a rotation prevention mechanism having a support pin, and wherein the support pin has an axis which passes substantially the center of tilt of the swash plate main part and a ball which is provided on one end of a connecting rod connected to one of the pistons and which is supported by the piston support.

12. A variable displacement swash plate type compressor, comprising: a main shaft adapted to be driven by a driving power source; a drive plate fixed to the main shaft; a swash plate main part tiltably engaging through an engaging portion with the drive plate so as to be tiltable with respect to the axis of the main shaft and to make a precessional rotation in accordance with the rotation of the main shaft; a piston support rotatably carried by the swash plate main part so as to make a precessional rotation together with the swash plate main part; pistons having one ends engaging with the piston support so as to reciprocatingly move in respective cylinders in accordance with the precessional rotation of the swash plate main part; and means for causing a change in the angle of tilt of the swash plate main part with respect to the axis of the main shaft so as to effect a control of displacement, wherein an unbalance of mass of the swash plate main part produced by the engaging portion is canceled so that the center of gravity of the swash plate main part is located substantially on the axis of the main shaft, and the center of gravity of the piston support is positioned substantially on the center of tilt of the swash plate main part, wherein the piston support includes a rotation prevention mechanism having a support pin, and wherein the piston support has a plurality of recesses for holding one ends of connecting rods connected to the pistons, the recesses being arranged in symmetry with respect to the axis of the support pin, the piston support being provided with additional masses between adjacent recesses so as to adjust the position of the center of gravity of the piston support.

13. A variable displacement swash plate type compressor according to claim 12, wherein each additional mass is formed by a member having a specific gravity greater than that of the material of the piston support.

14. A variable displacement swash plate type compressor according to claim 12, wherein the inertia produced by the rotation prevention mechanism is balanced by an additional mass provided on a portion of the piston support which is on the side of the axis of the main shaft opposite to the rotation prevention mechanism.

15. A variable displacement swash plate type compressor according to claim 12, wherein the additional masses are provided on the end of the piston support adjacent the pistons.

16. A variable displacement swash plate type compressor according to claim 12, wherein a recess is formed in a portion of the piston support which is on the same side of the center of tilt as the swash plate main part.

17. A variable displacement swash plate type compressor, comprising: a main shaft adapted to be driven by a driving power source; a drive plate fixed to the main shaft; a swash plate main part tiltable engaging through an engaging portion with the drive plate so as to be tiltable with respect to the axis of the main shaft and to make a precessional rotation in accordance with the rotation of the main shaft; a piston support rotatably carried by a swash plate main part so as to make a precessional rotation together with the swash plate main part; pistons having one ends engaging with the piston support so as to reciprocatingly move in respective cylinders in accordance with the precessional rotation of the swash plate main part; and means for causing a change in the angle of tilt of the swash plate main part with respect to the axis of the main shaft so as to effect a control of displacement, wherein the swash plate main part is shaped such that an unbalance of mass of the swash plate main part produced about the axis of the main shaft by the engaging portion is cancelled so that the center of gravity of the swash plate main part is located substantially on the axis of the main shaft, and the center of tilt of the swash plate main part is located substantially at the same position as the center of gravity of the piston support.

18. A variable displacement swash plate type compressor, comprising: a main shaft adapted to be driven by a driving power source; a drive plate fixed to the main shaft; a swash plate main part tiltable engaging through an engaging portion with the drive plate so as to be tiltable with respect to the axis of the main shaft and to make a precessional rotation in accordance with the rotation of the main shaft; a piston support rotatably carried by a swash plate main part so as to make a precessional rotation together with the swash plate main part; pistons having one ends engaging with the piston support so as to reciprocatingly move in respective cylinders in accordance with the precessional rotation of the swash plate main part; and means for causing a change in the angle of tilt of the swash plate main part with respect to the axis of the main shaft so as to effect a control of displacement, wherein the swash plate main part is shaped such that the mass distribution of the swash plate main part is so determined that the centrifugal force produced at least by the swash plate main part reduces the tilting angle of the swash plate main part.

19. A variable displacement swash plate type compressor, a main shaft adapted to be driven by a driving power source; a drive plate fixed to the main shaft; a swash plate main part tiltably engaging through an engaging portion with the drive plate so as to be tiltable with respect to the axis of the main shaft and to make a precessional rotation in accordance with the rotation of the main shaft; a piston support rotatably carried by the swash plate main part so as to make a precessional rotation together with the swash plate main part; pistons having one ends engaging with the piston support so as to reciprocatingly move in respective cylinders in accordance with the precessional rotation of the swash plate main part; and means for causing a change in the angle of tilt of the swash plate main part with respect to the axis of the main shaft so as to effect a control of displacement; wherein the swash plate main part is provided with a balancing portion which cancels an unbalance of mass produced by the engaging portion at a predetermined angle of tilt of the swash plate so as to locate the center of gravity of the swash plate main part substantially on the axis of the main shaft, wherein the main shaft is provided with a solenoid clutch having an armature, and wherein unbalance of centrifugal force produced by the drive plate is cancelled by a balancing mass provided on the armature of the solenoid clutch.

20. A variable displacement swash plate type compressor, comprising: a main shaft adapted to be driven by a driving power source; a drive plate fixed to the main shaft; a swash plate main part tiltably engaging through an engaging portion with the drive plate so as to be tiltable with respect to the axis of the main shaft and to make a precessional rotation in accordance with the rotation of the main shaft; a piston support rotatably carried by the swash plate main part so as to make a precessional rotation together with the swash plate main part; and pistons having one ends engaging with the piston support so as to reciprocatingly move in respective cylinders in accordance with the precessional rotation of the swash plate main part; and means for causing a change in the angle of tilt of the swash plate main part with respect to the axis of the main shaft so as to effect a control of displacement, wherein an unbalance of mass of the swash plate main part produced by the engaging portion is cancelled so that the center of gravity of the swash plate main part is located substantially on the axis of the main shaft, and the center of tilt of the swash plate main part is located substantially at the same position as the center of gravity of the piston support, wherein, representing the angle of tilt of the swash plate main part from a plane perpendicular to the axis of the main shaft by $\alpha$ and the angle formed between the plane and a line interconnecting the center of a ball of a connecting rod on the piston support and the center of tilt of the swash plate main part by $\beta$, when a condition $\alpha \leqq \beta$ is met, an additional mass is provided on a portion of the piston support which is on the same side as the pistons with respect to a plane passing through the center of tilt and having the angle of tilt the pistons, whereas, when a condition $\alpha > \beta$ is met, the additional mass is provided on the same side of the plane as the drive plate.

21. A variable displacement swash plate type compressor comprising: a main shaft adapted to be driven by a driving power source; a drive plate fixed to the main shaft; a swash plate main part tiltably engaging through an engaging portion with the drive plate so as to be tiltable with respect to the axis of the main shaft and to make a precessional rotation in accordance with the rotation of the main shaft; a piston support rotatably carried by the swash plate main part so as to make a precessional rotation together with the swash plate main part; and pistons having one ends engaging with the piston support so as to reciprocatingly move in response cylinders in accordance with the precessional rotation of the swash plate main part; and means for causing a change in the angle of tilt of the swash plate main part with respect to the axis of the main shaft so as to effect a control of displacement wherein an unbalance of mass of the swash plate main part produced by the engaging portion is canceled so that the center of gravity of the swash plate main part is located substantially on the axis of the main shaft, and the center of tilt of the swash plate main part is located substantially at the same position as the center of gravity of the piston support, wherein, representing the angle of tilt of the swash plate main part from a plane perpendicular to the axis of the main shaft by $\alpha$ and the angle formed between the plane and a line interconnecting the center of a ball of a connecting rod on the piston support and the center of tilt of the swash plate main part by $\beta$, when a condition $\alpha \leqq \beta$ is met, a recess is provided in a portion of the piston support which is on the same side as the drive plate with respect to a plane passing through the center of tilt and having the angle of tilt whereas, when a condition $\alpha > \beta$ is met, the recess is formed in a portion of the piston support which is one the same side of the plane as the drive plate.

* * * * *